US008672514B2

(12) United States Patent
Householder et al.

(10) Patent No.: US 8,672,514 B2
(45) **Date of Patent: *Mar. 18, 2014**

(54) REFLECTIVE VARIABLE SPOT SIZE LIGHTING DEVICES AND SYSTEMS

(75) Inventors: John R. Householder, Cedar Park, TX (US); Carlton S. Jones, Boxford, MA (US)

(73) Assignee: Fraen Corporation, Reading, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/351,545

(22) Filed: Jan. 17, 2012

(65) Prior Publication Data

US 2012/0140478 A1 Jun. 7, 2012

Related U.S. Application Data

(63) Continuation of application No. 12/404,107, filed on Mar. 13, 2009, now Pat. No. 8,118,451.

(60) Provisional application No. 61/036,359, filed on Mar. 13, 2008, provisional application No. 61/050,835, filed on May 6, 2008, provisional application No. 61/059,889, filed on Jun. 9, 2008, provisional application No. 61/097,750, filed on Sep. 17, 2008.

(51) Int. Cl.
*F21L 4/04* (2006.01)
*F21V 7/00* (2006.01)

(52) U.S. Cl.
USPC ..... 362/277; 362/104; 362/304; 362/319; 362/346

(58) Field of Classification Search
USPC ..... 362/296.01, 304, 346, 277, 281, 187, 362/319
See application file for complete search history.

(56) References Cited

U.S. PATENT DOCUMENTS

| | | | | |
|---|---|---|---|---|
| 1,513,211 | A | | 10/1924 | Barany |
| 2,338,078 | A | * | 12/1943 | Wood ..... 362/187 |
| 4,398,238 | A | | 8/1983 | Nelson |
| 4,907,141 | A | | 3/1990 | Wang |
| 4,984,140 | A | | 1/1991 | Ellion |
| 5,345,370 | A | | 9/1994 | Murray et al. |

(Continued)

FOREIGN PATENT DOCUMENTS

| | | | |
|---|---|---|---|
| DE | 4016531 | A1 | 11/1991 |
| JP | 03043903 | A | 2/1991 |
| WO | 2006087126 | | 8/2006 |

OTHER PUBLICATIONS

International Search Report for International Application No. PCT/US2009/037124, dated Jun. 12, 2009, 16 pages.

(Continued)

*Primary Examiner* — Peggy A. Neils
(74) *Attorney, Agent, or Firm* — Reza Mollaaghababa; Thomas J. Engellenner; Pepper Hamilton LLP

(57) ABSTRACT

In one aspect, a lighting system is disclosed that includes an inner reflector extending from a proximal end to a distal end along an axis, where the proximal end is adapted to receive light from a light source and the distal end provides an exit opening (aperture) for the received light. The system can further include an outer reflector that is axially positioned relative to the inner reflector. The inner and outer reflectors are coupled for axial movement relative to one another to change the flood spread of the light exiting the lighting system.

16 Claims, 32 Drawing Sheets

(56) References Cited

U.S. PATENT DOCUMENTS

| | | | | |
|---|---|---|---|---|
| 6,068,388 | A | 5/2000 | Walker et al. | |
| 6,193,388 | B1 | 2/2001 | Halasz et al. | |
| 6,273,590 | B1 | 8/2001 | Splane, Jr. | |
| 6,354,715 | B1 | 3/2002 | Halasz et al. | |
| 6,382,803 | B1 | 5/2002 | Arumugasaamy | |
| 6,464,377 | B2 * | 10/2002 | Splane, Jr. | 362/296.08 |
| 6,478,454 | B1 * | 11/2002 | Jaffari et al. | 362/307 |
| 6,543,911 | B1 | 4/2003 | Rizkin et al. | |
| 6,582,092 | B1 | 6/2003 | Marka | |
| 6,814,470 | B2 | 11/2004 | Rizkin et al. | |
| 6,874,914 | B2 | 4/2005 | Desanto et al. | |
| 6,899,443 | B2 | 5/2005 | Rizkin et al. | |
| 6,902,291 | B2 | 6/2005 | Rizkin et al. | |
| 6,951,418 | B2 | 10/2005 | Rizkin et al. | |
| 6,988,815 | B1 | 1/2006 | Rizkin et al. | |
| 7,001,041 | B2 * | 2/2006 | Halasz et al. | 362/205 |
| 7,014,341 | B2 | 3/2006 | King et al. | |
| 7,207,697 | B2 | 4/2007 | Shoji | |
| RE40,171 | E | 3/2008 | Halasz et al. | |
| 7,473,007 | B1 | 1/2009 | Wang | |
| 7,503,669 | B2 | 3/2009 | Rizkin et al. | |
| 7,682,038 | B2 * | 3/2010 | Wood | 362/187 |
| 7,828,461 | B2 | 11/2010 | Mayer et al. | |
| 8,118,451 | B2 * | 2/2012 | Householder et al. | 362/277 |
| 2006/0158895 | A1 | 7/2006 | Brands et al. | |
| 2007/0064415 | A1 | 3/2007 | Wood | |
| 2008/0074885 | A1 | 3/2008 | Brands et al. | |
| 2009/0135606 | A1 * | 5/2009 | Young | 362/310 |

OTHER PUBLICATIONS

Coast Product Catalog, 2009, 73 pages.
Photographs of lens used in Coast products; date unknown but available to Applicants as of May 2008, 6 pages.
Coast and LED Lenser Instruction Manual, Photonenpumpe V8, Item No. 7550, 7552, 7553, 7555, one page, May 25, 2005.
Coast and LED Lenser Instruction Manual, Frogman 7456, 7457, one page, May 25, 2005.
Coast and LED Lenser Instruction Manual, LED Lenser USB 7752, LED Lenser Roading Light 7751, Car Lenser 7750, one page, May 30, 2005.
Coast and LED Lenser Instruction Manual, LED Lenser V24 Light Performance, Item No. 7931, one page, Jul. 5, 2005.
Coast and LED Lenser Instruction Manual, LED Lenser V24 Light Performance, Item No. 7930, 7932, 7933, 7934, one page, Jul. 5, 2005.
Coast and LED Lenser Instruction Manual, LED Lenser V2 Giga Chip, Item No. 7459, accumulator for Item No. 7707, one page, Jul. 5, 2005.
Coast and LED Lenser Instruction Manual, Leflector—12 Volt LED Spot, Item No. 8000, 8002, 8003, 8004, 8014, 8014, 8023 one page, Jul. 17, 2005.
Coast and LED Lenser Instruction Manual, LED Lenser David rechargeable Lithium Item No. 7853, 7854, 7683, 7684, Battery Item No. 7792, Car Charging Station Item No. 7859, one page, Feb. 13, 2006.
Coast and LED Lenser Instruction Manual, LED Lenser V-Focus, Artikel Nr. 7845 / 7849 LED-Lenser V-Focus Black, Artikel Nr. 7846, LED-Lenser V-Focus Silver, one page, Mar. 16, 2006.
Coast and LED Lenser Instruction Manual, LED Lenser 7798 Dimm & Dive, one page, Jun. 16, 2006.
Coast and LED Lenser Instruction Manual, LED Lenser 7438 Hokus-Focus, one page, Jun. 16, 2006.
Coast and LED Lenser Instruction Manual, LED Lenser 7796 V2Focusable, one page, Jul. 19, 2006.
Coast and LED Lenser Instruction Manual, LED Lenser 7795 Focusable & Dimm, one page, Jul. 19, 2006.
Coast and LED Lenser Instruction Manual, LED Lenser V8 Car Lenser 7506, 7606, one page, Nov. 8, 2006.
Coast and LED Lenser Instruction Manual, LED Lenser 7575, 7675 Automotive, one page, Dec. 15, 2006.
Coast and LED Lenser Instruction Manual, LED Lenser 7752-U Reading Light, one page, Feb. 8, 2007.
Coast and LED Lenser Instruction Manual, LED Lenser 7855 USB_ Man, one page, Feb. 9, 2007.
Coast and LED Lenser Instruction Manual, LED Lenser 7979 Focus Duplex Black, 7977 Biker Duplex silver, one page, Feb. 26, 2007.
Coast and LED Lenser Instruction Manual, LED Lenser 7874 Worker's Friend, one page, Mar. 13, 2007.
Coast and LED Lenser Instruction Manual, LED Lenser 9854 Snake-Moppel, one page, Mar. 22, 2007.
Coast and LED Lenser Instruction Manual, LED Lenser 9856 Space-Moppel, one page, Mar. 22, 2007.
Coast and LED Lenser Instruction Manual, LED Lenser 9861 Lichterloh, one page, Mar. 22, 2007.
Coast and LED Lenser Instruction Manual, Eddie Bauer® Lantern, Style #EB4205GB, one page, no date available.
International Preliminary Report on Patentability mailed Mar. 25, 2010 for corresponding PCT Application No. PCT/US2009/037124.
European Office Action issued Sep. 10, 2013 for App. No. 09720629.6 (7 pages).
European Office Action issued Jan. 3, 2013 for App. No. 09720629.6 (9 pages).

* cited by examiner

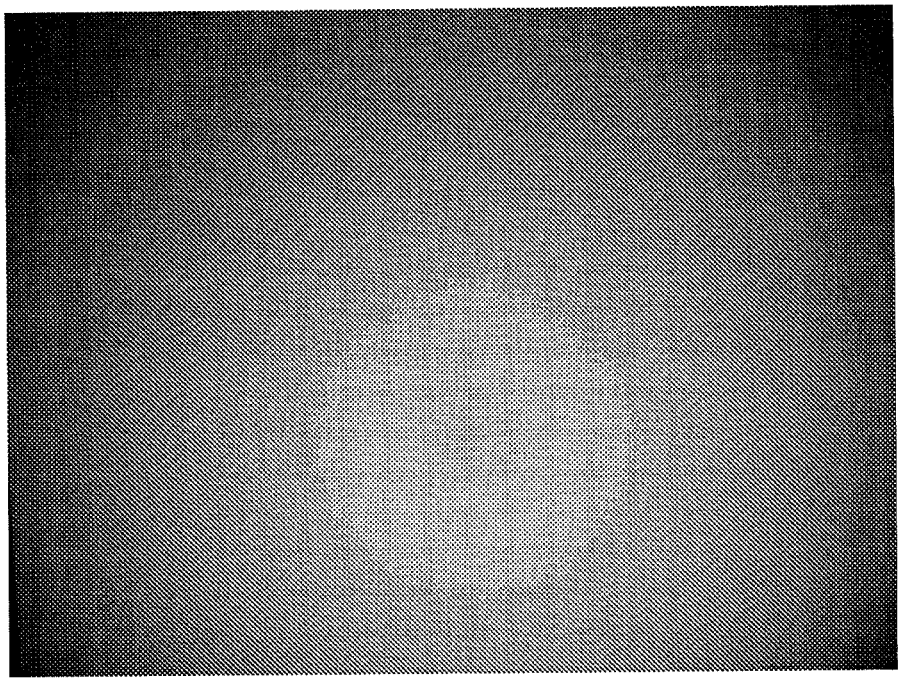
Figure 20: actual picture of the projected light spot
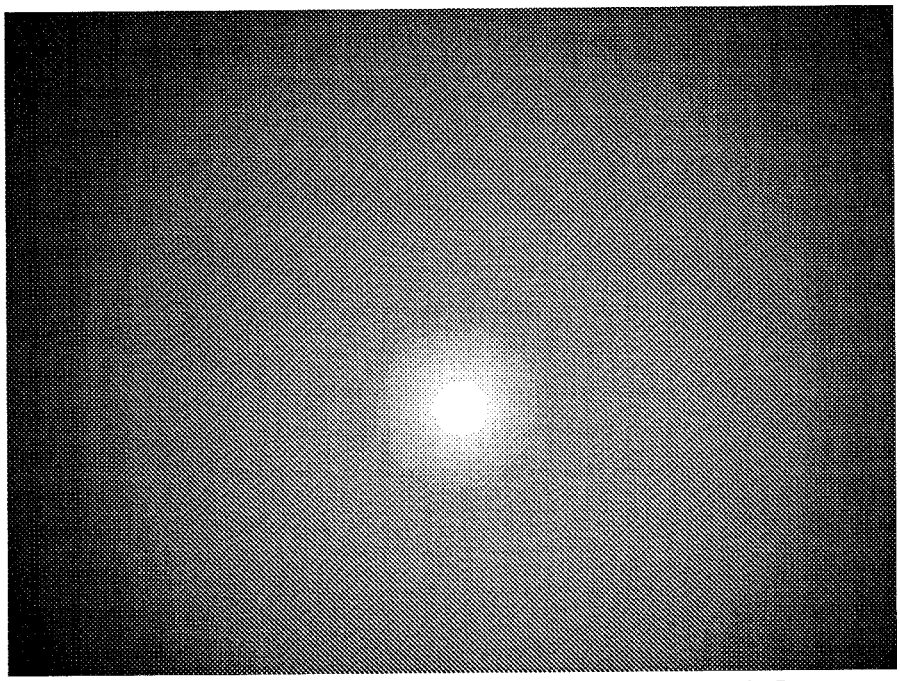
Figure 21: actual picture of the projected light spot

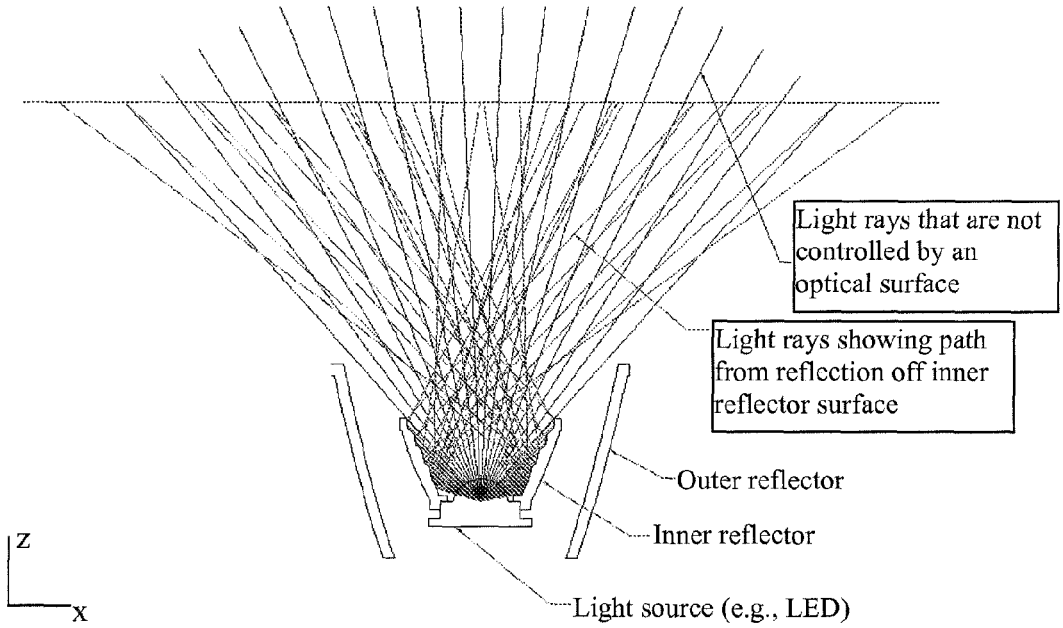
Figure 27: inner reflector design ray path details

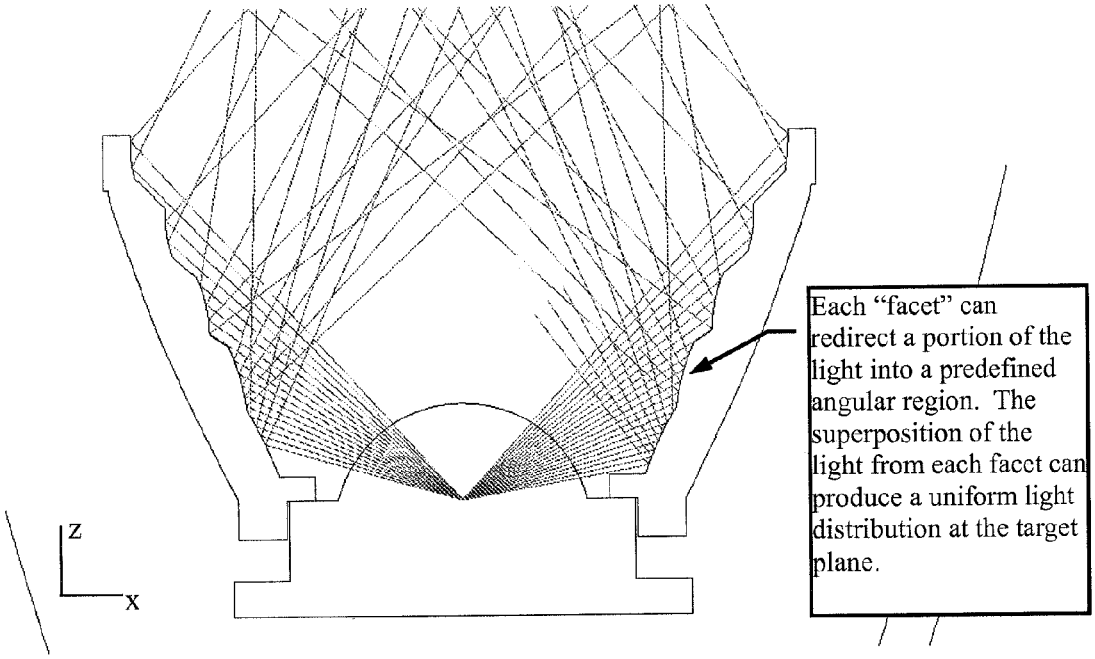
Figure 28: inner reflector ray path close-up

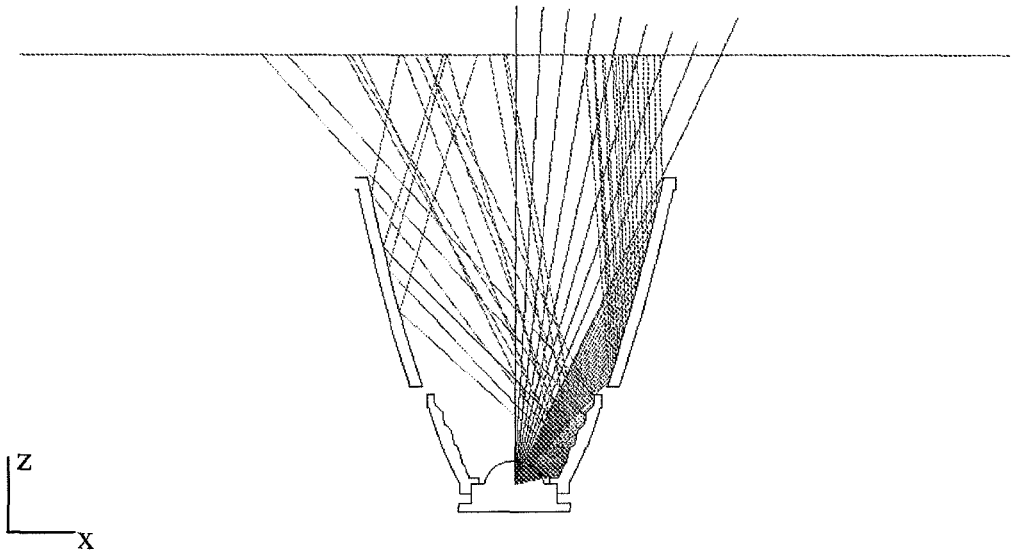
Figure 29: outer reflector (and inner) ray path details

| Narrow beam (extended position) | Wide beam (retracted position) |
| --- | --- |
| 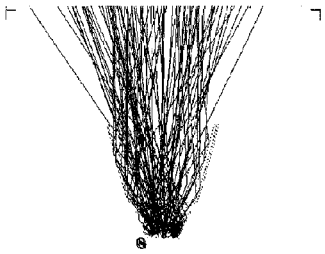 | 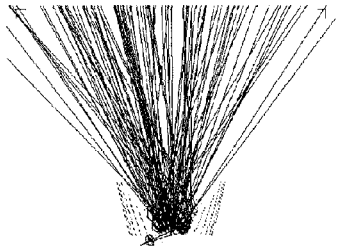 |
| **Figure 30: raytrace - narrow beam** | **Figure 31: raytrace - wide beam** |

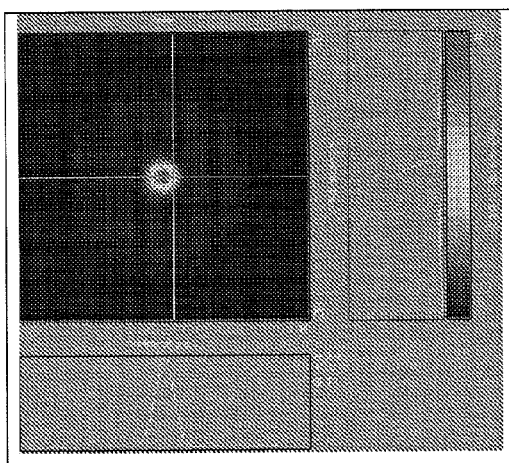
Figure 32: narrow beam - intensity vs. angle
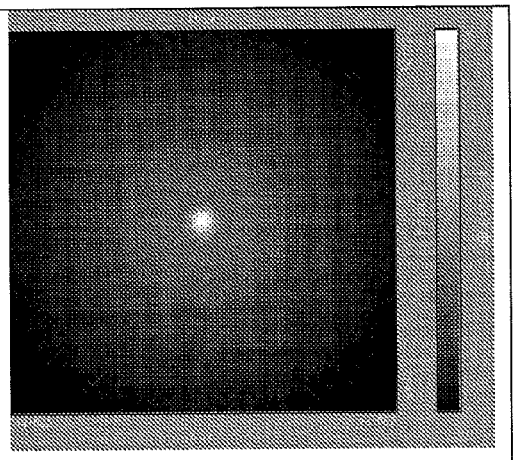
Figure 34: narrow beam - lit appearance
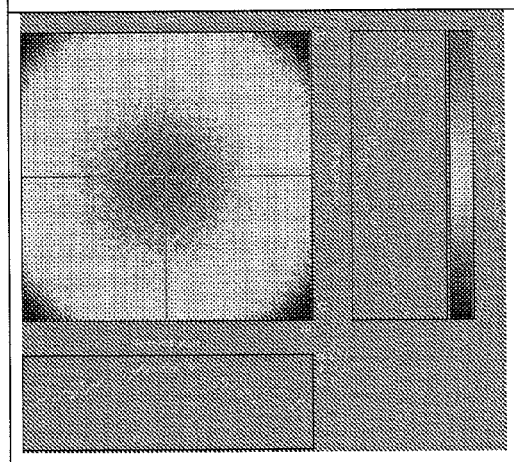
Figure 33: wide beam - intensity vs. angle
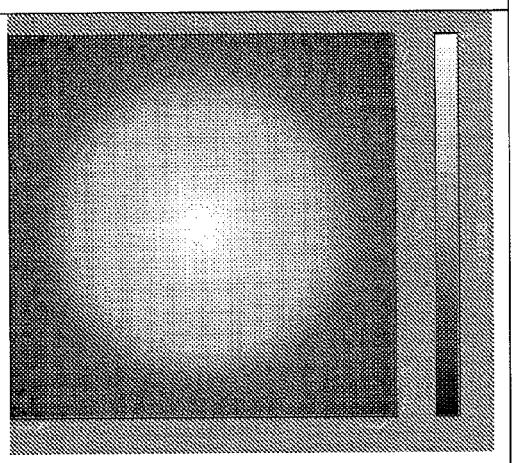
Figure 35: wide beam - lit appearance

| Angle | Narrow | Wide |
|---|---|---|
| -35 | 12 | 48 |
| -34 | 13 | 51 |
| -33 | 15 | 54 |
| -32 | 17 | 57 |
| -31 | 19 | 59 |
| -30 | 19 | 61 |
| -29 | 21 | 62 |
| -28 | 23 | 62 |
| -27 | 25 | 63 |
| -26 | 29 | 65 |
| -25 | 39 | 68 |
| -24 | 56 | 68 |
| -23 | 72 | 70 |
| -22 | 79 | 72 |
| -21 | 79 | 74 |
| -20 | 81 | 74 |
| -19 | 85 | 76 |
| -18 | 90 | 80 |
| -17 | 94 | 80 |
| -16 | 97 | 81 |
| -15 | 102 | 82 |
| -14 | 106 | 83 |
| -13 | 111 | 84 |
| -12 | 119 | 89 |
| -11 | 125 | 93 |
| -10 | 126 | 94 |
| -9 | 122 | 95 |
| -8 | 118 | 98 |
| -7 | 123 | 103 |
| -6 | 153 | 102 |
| -5 | 260 | 103 |
| -4 | 522 | 105 |
| -3 | 1031 | 107 |
| -2 | 1773 | 107 |
| -1 | 2508 | 110 |

| Angle | Narrow | Wide |
|---|---|---|
| 0 | 2828 | 112 |
| 1 | 2506 | 110 |
| 2 | 1794 | 105 |
| 3 | 1037 | 106 |
| 4 | 503 | 108 |
| 5 | 238 | 106 |
| 6 | 139 | 102 |
| 7 | 117 | 102 |
| 8 | 115 | 99 |
| 9 | 117 | 96 |
| 10 | 121 | 94 |
| 11 | 123 | 93 |
| 12 | 120 | 89 |
| 13 | 114 | 86 |
| 14 | 107 | 82 |
| 15 | 99 | 80 |
| 16 | 94 | 79 |
| 17 | 89 | 77 |
| 18 | 85 | 74 |
| 19 | 81 | 71 |
| 20 | 77 | 70 |
| 21 | 74 | 68 |
| 22 | 71 | 67 |
| 23 | 63 | 66 |
| 24 | 47 | 66 |
| 25 | 31 | 66 |
| 26 | 23 | 63 |
| 27 | 22 | 61 |
| 28 | 22 | 61 |
| 29 | 20 | 58 |
| 30 | 18 | 55 |
| 31 | 16 | 54 |
| 32 | 15 | 52 |
| 33 | 13 | 50 |
| 34 | 12 | 45 |
| 35 | 11 | 42 |

Figure 37

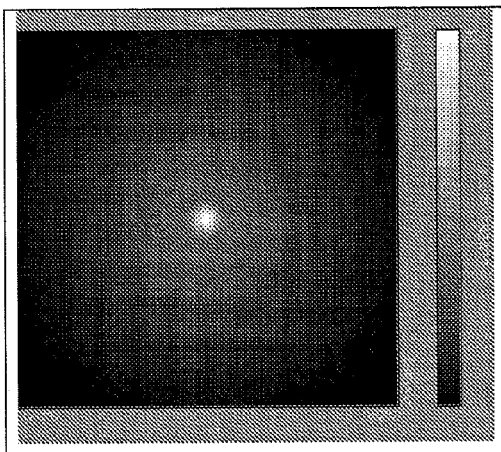
Figure 38: narrow beam – simulation
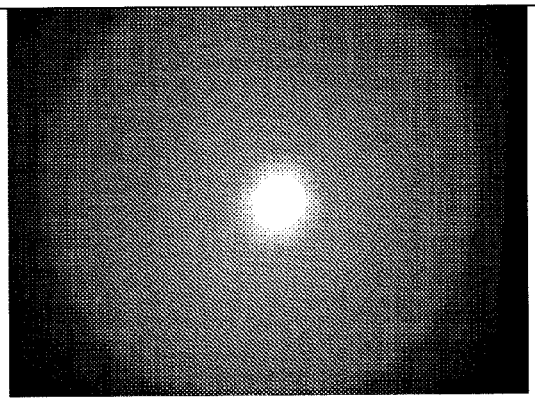
Figure 39: narrow beam – prototype beam picture
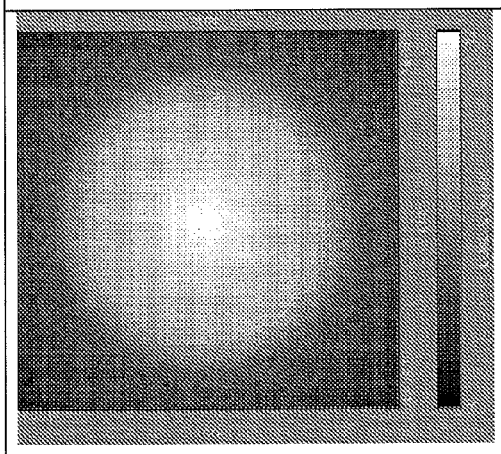
Figure 40: wide beam – simulation
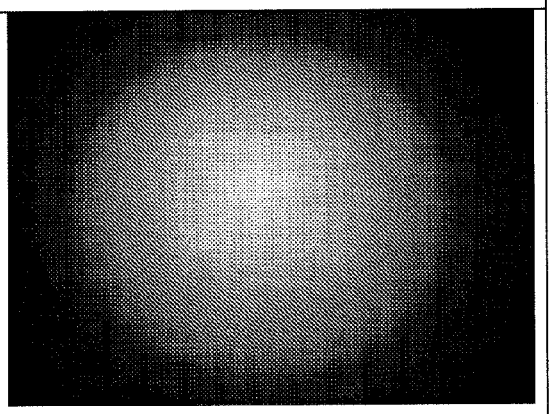
Figure 41: wide beam – prototype beam picture

REFLECTIVE VARIABLE SPOT SIZE LIGHTING DEVICES AND SYSTEMS

RELATED APPLICATIONS

The present application is a continuation of U.S. patent application Ser. No. 12/404,107, filed on Mar. 13, 2009 (now U.S. Pat. No. 8,118,451), which claims priority to a U.S. provisional application entitled "Reflective Variable Spot Size Lighting System" having a Ser. No. 61/036,359 and filed on Mar. 13, 2008, a U.S. provisional application entitled "Reflective Variable Spot Size Lighting Devices and Systems" having a Ser. No. 61/050,835 and filed May 6, 2008, a U.S. provisional application entitled "Reflective Variable Spot Size Lighting Devices and Systems" having a Ser. No. 61/059,889 and filed Jun. 9, 2008, and a U.S. provisional application entitled "Reflective Variable Spot Size Lighting Devices and Systems" having a Ser. No. 61/097,750 and filed on Sep. 17, 2008. The foregoing patent application Ser. No. 12/404,107 and all of the foregoing provisional applications are herein incorporated by reference in their entirety.

BACKGROUND

The present patent application relates generally to light-emitting systems, and more particularly to such systems that employ reflective surfaces to produce adjustable lighting patterns.

Lighting systems for high-power light sources, such as light emitting diodes, can have a wide variety of configurations. In many cases, a particular configuration can be characterized by the illumination pattern it produces, by the coherence, intensity, efficiency and uniformity of the light projected by it, and so on. The application for which the lens and/or lighting system is designed may demand a high level of performance in many of these areas.

Many applications call for the ability to focus or change the size of a projected light spot. For example, flashlights, spotlights, and adjustable or customizable lighting systems, among others, all can utilize such focusing capabilities. However, creating a device that can provide such an adjustable lighting pattern is challenging. To date, lighting systems with focusing features have typically included single reflectors that can be moved with respect to the light source to change the size of a light spot projected onto a target surface. The capabilities of such systems are limited and their illumination characteristics are typically sub-optimal.

Accordingly, there is a need for improved lighting systems, and particularly those with adjustable focusing ability.

SUMMARY

In one aspect, a lighting system is disclosed which comprises an inner reflector extending from a proximal end to a distal end along an axis, where the inner reflector is adapted to receive light from a light source at its proximal end. The lighting system also includes an outer reflector extending from a proximal end to a distal end through which light can exit the outer reflector. The proximal end of the outer reflector is optically coupled to the distal end of the inner reflector to receive light therefrom. Further, the inner and outer reflectors are coupled for axial movement relative to one another over a range of relative positions between a retracted position and an extended position, and the light exiting the outer reflector exhibits a progressively decreasing flood spread as the relative position of the reflectors is transitioned from said retracted position to said extended position.

In some embodiments, an axial overlap between the two reflectors is less in the extended position than in the retracted position. In the extended position, for example, the distal end of said inner reflector can axially abut the proximal end of said outer reflector. In some cases, the retracted position is characterized by a maximum axial overlap between the two reflectors within said range of relative positions, and the extended position is characterized by a minimum axial overlap between the two reflectors within said range of relative positions.

In some embodiments, the inner and outer reflectors of the lighting system can be configured such that an illumination area generated by light exiting the outer reflector exhibits a ratio of maximum to minimum intensity level of about 1.3:1 or less when said inner and outer reflectors are in said retracted position. Further, the inner and outer reflectors can be configured such that an illumination area generated by light exiting the outer reflector exhibits a ratio of maximum to minimum intensity level of about 10:1 or more when said inner and outer reflectors are in said extended position.

In another aspect, a lighting system is disclosed which comprises an inner reflector extending from a proximal end to a distal end along an axis, where the inner reflector is adapted to receive light from a light source at its proximal end. The lighting system also includes an outer reflector extending from a proximal end to a distal end through which light can exit the outer reflector. The proximal end of the outer reflector is optically coupled to the distal end of the inner reflector to receive light therefrom. Further, the inner and outer reflectors are coupled for axial movement relative to one another over a range of relative positions between a retracted position and an extended position. The inner and outer reflectors are configured such that an illumination area generated by light exiting the outer reflector exhibits a ratio of maximum to minimum intensity level of about 2:1 or less, or in other cases, of about 1.3:1 or 1.2:1 or less, when said inner and outer reflectors are in said retracted position and an illumination area generated by light exiting the outer reflector exhibits a ratio of maximum to minimum intensity level of about 10:1 or more, or in other cases about 20:1 or more, or about 30:1 or more, when said inner and outer reflectors are in said extended position.

In some embodiments, the illumination pattern generated when said inner and outer reflectors are in the extended position comprises a central region surrounded by an annular region and said ratio of maximum intensity level of about 10:1 or more (or in other cases, 20:1 or 30:1 or more) represents a ratio of intensity level of said central region relative to said annular region.

In some embodiments, an axial overlap between the two reflectors is less in the extended position than in the retracted position. In the extended position, for example, the distal end of said inner reflector can axially abut the proximal end of said outer reflector. In some cases, the retracted position is characterized by a maximum axial overlap between the two reflectors within said range of relative positions, and the extended position is characterized by a minimum axial overlap between the two reflectors within said range of relative positions.

In another aspect, a lighting system is disclosed that includes an inner reflector extending from a proximal end to a distal end along an axis, where the proximal end is adapted to receive light from a light source and the distal end provides an exit opening (aperture) for the received light. The system can further include an outer reflector that is axially positioned relative to the inner reflector. The outer reflector extends from a proximal end adapted to receive light from the light source to a distal end that provides an exit opening (aperture) for the received light. The inner and outer reflectors are axially movable relative to one another and are configured such that distal movement of the outer reflector (that is, a movement away from the inner reflector) along the axis about which the reflectors are disposed progressively reduces a flood spread produced by the lighting system. For example, a transition of the reflectors from a retracted position (e.g., a nested position) to an extended position can progressively reduce the flood spread produced by the lighting system.

In some embodiments, the inner and outer reflectors can be configured such that the distal movement of the outer reflector along the axis produces a central bright spot within an illumination pattern produced by the lighting system. In some embodiments, as the outer reflector is moved relative to the inner reflector (e.g., as the reflectors are transitioned from a retracted position to an extended position in a telescopic fashion), an increasing amount of the output light is concentrated within the central bright spot with the remaining light forming a lower intensity annulus about the central bright spot.

In another aspect, a lighting system is disclosed that includes an inner reflector extending from a proximal end to a distal end along an axis, and an outer reflector that is axially positioned relative to the inner reflector. The outer reflector extends from a proximal end adapted to receive light from the light source to a distal end that provides an exit opening for the received light. The inner and outer reflectors are axially movable relative to one another and are configured such that, for at least one relative position of the reflectors (e.g., an extended position), a maximum divergence angle relative to the axis exhibited by the light exiting the distal end of the inner reflector is more than a corresponding maximum divergence angle for the light exiting the distal end of the outer reflector.

In another aspect, the invention provides a lighting system that includes an inner reflector and an outer reflector that are coupled for movement relative to one another. In many embodiments, each of the inner and the outer reflector has inner and outer surfaces with the inner surface providing a reflective surface. The inner reflector is disposed about an axis for receiving light from a light source located along that axis and for reflecting at least some of that light. The inner reflector is configured such that the light exiting therefrom exhibits a first maximum divergence angle. The outer reflector is disposed axially relative to the inner reflector for receiving light from the light source and for reflecting at least a portion of that light. The outer reflector is configured such that the light exiting therefrom, for at least one relative position of the two reflectors along the axis (e.g., an extended position), exhibits a second maximum divergence angle, where the second divergence angle is less than the first divergence angle.

In the above lighting system, the inner and outer reflectors can be coupled for movement relative to one another between a retracted position, in which the outer reflector is entirely disposed proximal to the distal end of the inner reflector, and an extended position, in which at least a portion of the outer reflector is disposed distal to the inner reflector. In some cases, the inner reflector can be, in some positions, nested or disposed at least partially within the outer reflector. The inner and the outer reflectors can be coupled for telescopic movement relative to one another between an extended position and a retracted position. In some embodiments, in the extended position the inner and outer reflectors can be positioned so as to axially abut one another along their common axis (that is, with no or substantially no overlap) and can form a substantially continuous reflective surface. Further, in some embodiments, the inner and outer reflectors are substantially equal in height along their common axis.

In some embodiments, the outer reflector collimates light received from the light source for at least one position of the outer reflector along the axis.

In some embodiments, the light source can be disposed at a focal point of at least one of the inner or the outer reflector. For example, the light source can be attached to the inner reflector, e.g., such that the light source is fixedly disposed at the focal point of the inner reflector. In some cases, the light source can be disposed at a focal point of the outer reflector when the inner and the outer reflectors are in an extended position relative to one another.

In some implementations, at least one of the inner and the outer reflector has a parabolic profile. In other implementations, at least one of the inner reflector and the outer reflector comprises a faceted surface for reflecting at least a portion of the received light. By way of example, the faceted surface can comprise a plurality of sections having in may cases generally concave profile, e.g., a conical profile or any other suitable profile. In some cases, the faceted surface is configured such that movement of the faceted surface relative to a light source (e.g., an axial movement) can vary an illumination pattern generated by the lighting system. In some cases, the faceted surface can be asymmetric (e.g., rotationally or axially asymmetric) so that its movement (e.g., axial movement) causes an asymmetric variation of the illumination pattern generated by the lighting system.

A variety of light sources can be employed in the lighting systems of the invention. By way of example, the light source can comprise a light-emitting diode, a laser diode, a tungsten filament, a high intensity discharge lamp, a short arc lamp, a plasma arc lamp, etc.

In another aspect, an illumination device is disclosed that includes an inner reflector disposed about an axis for reflecting light from a light source located along the axis, where the reflection can be characterized by a first maximum divergence angle. The illumination device can further include an outer reflector disposed coaxially with the inner reflector for reflecting light from the light source, where the reflection from the outer reflector can be characterized by a second maximum divergence angle that is less than the first maximum divergence angle (e.g., for at least one relative position of the two reflectors). The inner and the outer reflector can cooperatively direct light from the light source to a target surface to form an illumination spot thereon. The device can further include an adjustment mechanism that is coupled to the inner reflector and the outer reflector for adjusting the relative positions of those reflectors and thereby changing the illumination spot. In some implementations, the adjustment mechanism can continuously adjust the relative positions of the inner and outer reflectors. In some other implementations, the adjustment mechanism can allow a user to select one relative position of the inner and outer reflectors amongst a discrete number of such positions.

The illumination device can include a housing in which the inner and the outer reflectors are disposed, where at least a portion of the housing forms a handle. A portable electric power source can be disposed in the housing for powering the light source, e.g., a light emitting diode. In some cases, the illumination device can be a flashlight.

In another aspect, a lighting system is disclosed that includes a lens disposed about an axis and optically coupled to a light source and an inner reflector that is disposed coaxially with the lens. The inner reflector can include an anterior surface and a posterior surface, where the posterior surface is configured to receive and reflect light from the lens. The lighting system can further include an outer reflector that is disposed coaxially with the inner reflector for receiving light reflected from the inner reflector and reflecting that received light, e.g., away from the lighting system and onto a target surface. The inner and the outer reflectors can be coupled for movement relative to one another. In some implementations, at least one of the lens and the inner reflector is disposed within the outer reflector.

In some implementations of the above lighting system, a relative movement of the inner reflector and the outer reflector away from one another can concentrate progressively more of the light rays leaving the lighting system into a central region. For example, more of the light rays can be concentrated onto a central bright spot of light projected onto a target surface.

In some implementations, the posterior surface of the inner reflector faces the lens. The posterior surface can be in the form of a tapered surface, e.g., one that is tapered to a point. Further, the outer reflector can have a parabolic profile having an inner reflective surface.

In another aspect, a lighting system is disclosed that includes a lens disposed about an axis and optically coupled to a light source, and an inner reflector disposed along the axis. The inner reflector can have distal and proximal surfaces, where the proximal surface is configured to receive light from the lens and reflect at least a portion of the received light. The lighting system can further include an outer reflector that is disposed along the axis for receiving light reflected from the inner reflector and reflecting at least a portion of that light, e.g., onto a target surface. The light source, the lens, the inner reflector, and the outer reflector are oriented with respect to one another such that light from the light source passes through the lens at least partially in a first direction, is reflected at least partially at the proximal surface of the inner reflector at least partially in a second direction that opposes the first direction (or, for example, that has a vector component that opposes the first direction), and is reflected at the outer reflector at least partially in the first direction.

In some embodiments, the inner and the outer reflector are movably coupled to one another such that their relative movement varies an output illumination pattern generated by the lighting system. For example, the reflectors can be disposed telescopically relative to one another such that a relative movement of the reflectors from a retracted position to an extended position reduces the flood spread and changes the uniformity of the light projected onto a target surface such that progressively more of the light is concentrated in a central region so as to provide a bright spot surrounded by a lower intensity region.

In some embodiments, in the above lighting system, at least one of the inner reflector and the outer reflector comprises a faceted surface for reflecting at least a portion of the received light. In some cases, the faceted surface can include a plurality of concave sections which can approximate a conical profile. In some cases, the faceted surface is configured such that its movement relative to the light source varies an output illumination pattern of the lighting system. In some cases, the faceted surface can be asymmetric (e.g., rotationally or axially asymmetric) such that its movement would cause an asymmetric variation in the output illumination pattern generated by the lighting system.

In another aspect, a lighting system is disclosed that includes a reflector extending from a proximal end to a distal end along an axis, where the proximal end is adapted to receive light from a light source and the distal end provides an exit opening for the received light. The reflector includes a first reflective region for receiving light from the light source located along the axis and for reflecting at least some of that light. The first reflective region is configured such that the light reflected therefrom exhibits a first maximum divergence angle. The reflector includes a second reflective region for receiving light from the light source and for reflecting at least some of that light. The second reflective region is configured such that the light reflected therefrom exhibits a second maximum divergence angle, where the second divergence angle is greater than the first divergence angle. In many cases, the first reflective region can be proximal to the second reflective region.

In some implementations of the above lighting system, the maximum divergence angles corresponding to the first and second reflective regions can have a difference in a range of about 8 degrees to about 60 degrees.

In some embodiments, one of the reflective regions can include a plurality of facets while the other reflective region has a smooth surface. The plurality of facets can be adapted to collectively reflect light incident thereon into an angular region. In some cases, the plurality of facets are adapted to collectively reflect light incident thereon to produce a substantially uniform output illumination area on a target surface.

In some embodiments, the lighting system can include a light source located along the axis, where the light source and the reflector are coupled for movement relative to one another. In some cases, the first reflective region is adapted to collimate light received from a light source located at a focal point thereof.

In another aspect, a lighting system is disclosed that includes a reflector extending from a proximal end to a distal end along an axis and having two or more differing reflective regions (e.g., a first region proximal to a second region). The proximal end of the reflector is adapted to receive light from a light source while its distal end provides an exit opening for the received light. The lighting system can further include a light source located along the axis, where the light source and the reflector are coupled for axial movement relative to one another, such that the relative distal movement of the light source (e.g., movement away from the proximal end of the reflector) along the axis progressively increases a flood spread produced by the lighting system.

In some implementations, at least one of the reflective regions is adapted to collimate light reflected thereby.

In some embodiments, at least one of the reflective regions can comprise a plurality of facets or can include a smooth inner surface. In some cases, at least one of the reflective regions comprises a plurality of facets and at least another reflective region comprises a smooth inner surface. In some cases, the facets are adapted to reflect light incident thereon into an angular region. In some cases, the facets are adapted to collectively reflect light incident thereon so as to produce a substantially uniform output illumination area on a target surface. The uniformity of the illumination area can be defined as the ratio of the maximum to the minimum light level within the illumination area. In some preferred embodiments, the light pattern generated by the lighting system, for at least one position of the light source relative to the reflector, can exhibit a uniformity of at least about 1.2:1.

A further understanding of various aspects of the invention can be obtained by reference to the following detailed description in conjunction with the associated drawings, which are discussed briefly below.

BRIEF DESCRIPTION OF DRAWINGS

FIG. 20 is a photograph of a projected light spot produced by the lighting system of Example 1 in a wide beam position;

FIG. 21 is a photograph of a projected light spot produced by the lighting system of Example 1 in a narrow beam position;

FIG. 27 is a ray trace illustrating the two-reflector lighting system designed for Example 2 in a retracted position;

FIG. 28 is a closeup view of the ray trace of FIG. 27;

FIG. 29 is a ray trace illustrating the two-reflector lighting system designed for Example 2 in an extended position;

FIG. 30 is a ray trace illustrating the two-reflector lighting system designed for Example 2 in an extended position;

FIG. 31 is a ray trace illustrating the two-reflector lighting system designed for Example 2 in a retracted position;

FIG. 32 is an exemplary illustration of the intensity of a light pattern produced on a target surface by the lighting system designed for Example 2 in the extended (narrow beam) position of FIG. 22 and includes graphs depicting the light intensity versus angle obtained on that target surface;

FIG. 33 is an exemplary illustration of the intensity of a light pattern produced on a target surface by the lighting system designed for Example 2 in the retracted (wide beam) position of FIG. 23 and includes graphs depicting the light intensity versus angle obtained on that target surface;

FIG. 34 is an exemplary illustration of the light pattern produced on a target surface by the lighting system in the extended (narrow beam) position of FIG. 22;

FIG. 35 is an exemplary illustration of the light pattern produced on a target surface by the lighting system designed for Example 2 in the retracted (wide beam) position of FIG. 23;

FIG. 37 is a table containing data used to plot the graph of FIG. 36;

FIG. 38 is an exemplary illustration of the light pattern produced on a target surface by the lighting system of Example 3 in the extended (narrow beam) position;

FIG. 39 is a photograph of the light pattern produced on a target surface by the lighting system of Example 3 in the extended (narrow beam) position;

FIG. 40 is an exemplary illustration of the light pattern produced on a target surface by the lighting system of Example 3 in the retracted (wide beam) position;

FIG. 41 is a photograph of the light pattern produced on a target surface by the lighting system of Example 3 in the retracted (wide beam) position;

DETAILED DESCRIPTION

Figure 1:
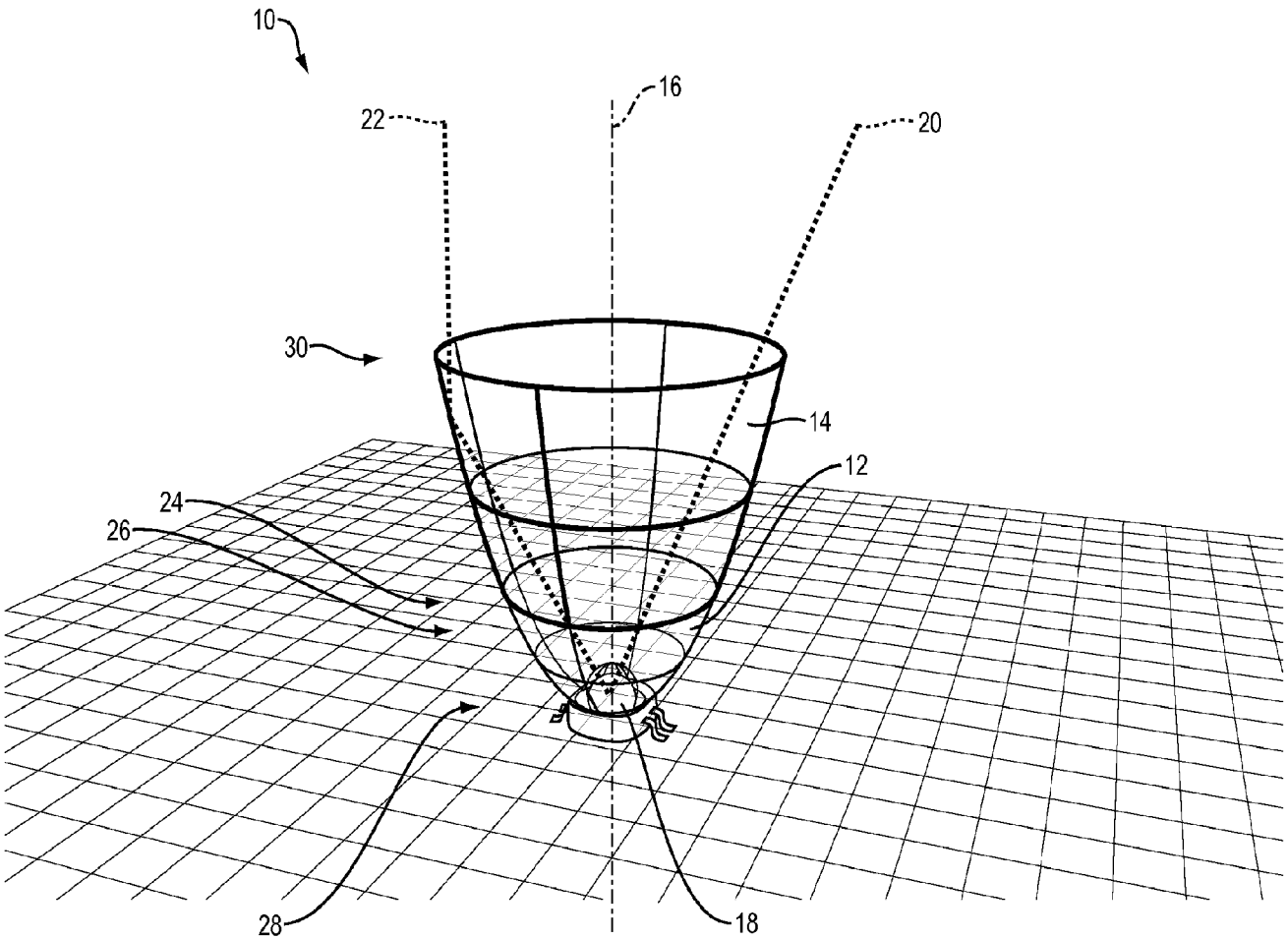
FIG. 1 schematically depicts an exemplary embodiment of a two-reflector lighting system according to the invention in a fully extended position.

The present application relates generally to lighting or illumination systems and associated methods that employ one or more optical reflectors to generate a desired, typically adjustable, light pattern. Such devices and methods can be used with a wide variety of light sources, including light-emitting-diodes and incandescent bulbs. Such devices and methods can have wide application, including, for example, in flashlights, spot lighting, customizable/adjustable lighting systems, household lighting, wearable headlamps or other body-mounted lighting, among others. Further, they can be useful in applications requiring illumination in conditions of degraded visibility, such as underwater lighting, emergency services lighting (e.g., firefighter headlamps), or military applications.

As will be described in more detail below, some embodiments can advantageously produce a relatively narrow beam to illuminate an object (in some cases, illuminating an object at a long distance, in conditions of degraded visibility, or otherwise) while providing a surrounding illumination that is relatively uniform (for example, to provide context or peripheral vision, such as when spotlighting an actor on a stage, or when illuminating a narrow footpath and the vegetation at its edges). For example, some embodiments can advantageously provide the ability to adjust the lighting pattern from a relatively narrow to a relatively wide beam pattern (and vice versa), with the wide beam providing a different illumination pattern (for example, a wide beam of relatively uniform illumination) than the narrow beam.

Throughout this specification, the term "e.g." will be used as an abbreviation for the non-limiting phrase "for example." The term "reflector" as used herein refers to an optical component that includes at least one reflective surface, e.g., a surface that can cause specular reflection of light incident thereon. In many cases, the reflective surface can exhibit a reflectance greater than about 80%, preferably greater than about 85% or 90% or 95% or about 100%, in the visible range of the electromagnetic spectrum, e.g., for wavelengths in a range of about 400 nm to about 700 nm.

In one embodiment, an exemplary lighting system generally can include an inner reflector and an outer reflector coaxially disposed along an axis. The inner reflector can have a proximal end adapted to receive light from a light source (e.g., one that is fixedly attached thereto), and a distal end through which the light exits the reflector. Similarly, the outer reflector can have a proximal end adapted to receive light (e.g., directly from a light source or via reflection from the inner reflector) and a distal end through which the light exits the reflector.

The inner and outer reflectors can be configured to move relative to one another along the axis (e.g., from a retracted position to an extended position). In some embodiments, in a retracted position, the outer reflector can circumferentially surround or overlap the inner reflector such that the distal end of the outer reflector is withdrawn proximal to the distal end of the inner reflector. In such a position, the inner reflector can produce an illumination pattern on a target surface which exhibits a particular flood spread. The flood spread, for example, can be characterized by the maximum divergence angle of light rays exiting the lighting system relative to the optical axis of the lighting system. As the outer reflector moves distally along the axis (e.g., such that an increasing portion of the outer reflector is disposed distal to the distal end of the inner reflector with a concomitant decrease in the axial overlap between the reflectors, and can receive light from the inner reflector and/or light source), the outer reflector can progressively reduce the flood spread of light exiting the lighting system.

Figures 22, 23:
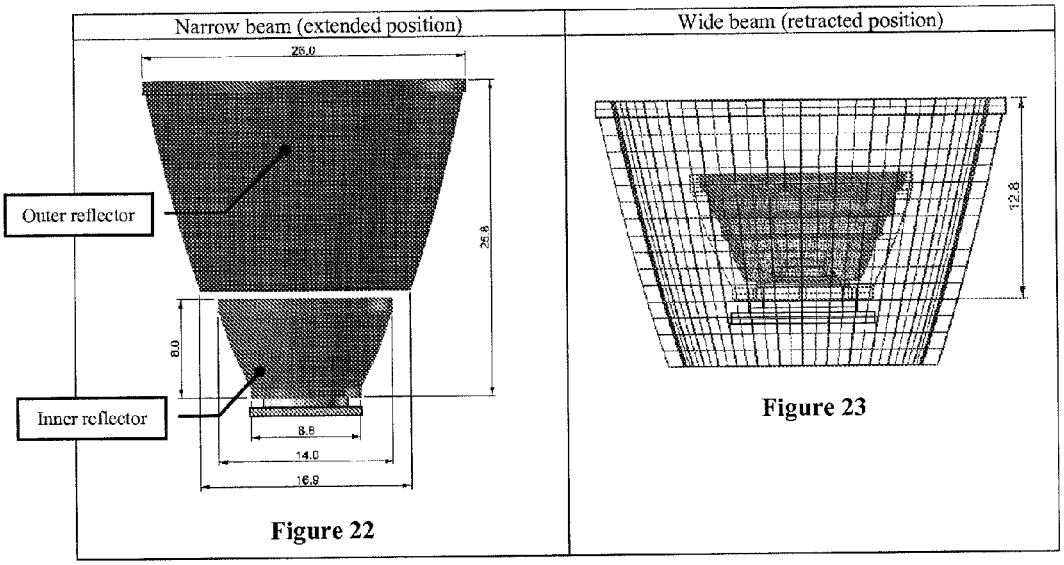
FIG. 22 is a schematic view of a two-reflector lighting system in an extended position as designed for Example 2.
FIG. 23 is a schematic view of a two-reflector lighting system in a retracted position as designed for Example 2.

In some cases, the flood spread of the lighting system (the spread of light rays exiting the lighting system) for a given position of the reflectors can be characterized by the light spot produced on a target surface, as shown for example in FIGS. 21-22. FIG. 21 shows a wide and uniform illumination area (relative to FIG. 22) which can correspond to the retracted position described above. Distal movement of the outer reflector can cause the outer reflector to reduce the flood spread by concentrating at least some of the light into a smaller area, creating a central bright spot having a relatively high luminosity (relative to the diffuse annular region surrounding it), which is shown for example in FIG. 22. However, it should be understood that, in some embodiments, distal movement of the outer reflector can reduce the flood spread without necessarily creating such a bright spot.

In many cases, the outer reflector can reduce flood spread by redirecting (e.g., reflecting) at least some of the light received from the inner reflector and/or the light source. For example, the outer reflector can redirect light received from the light source towards an optical axis (e.g., a central axis of the lighting system), and/or can redirect light substantially parallel to the axis. As the outer reflector is moved distally, it can redirect an increasing amount of light, thereby reducing flood spread and/or creating a central bright spot.

Figure 2:
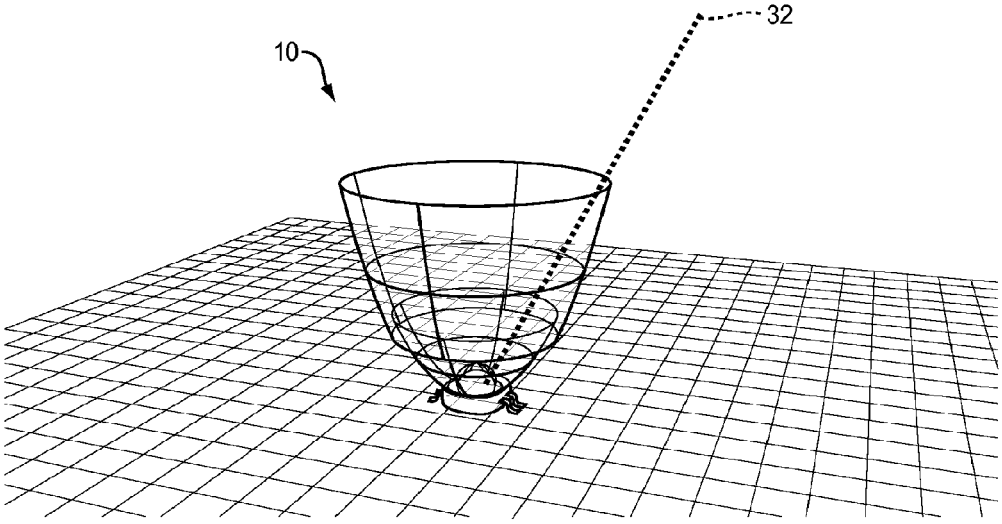
FIG. 2 schematically depicts the lighting system of FIG. 1 in an intermediate position.
Figure 3:
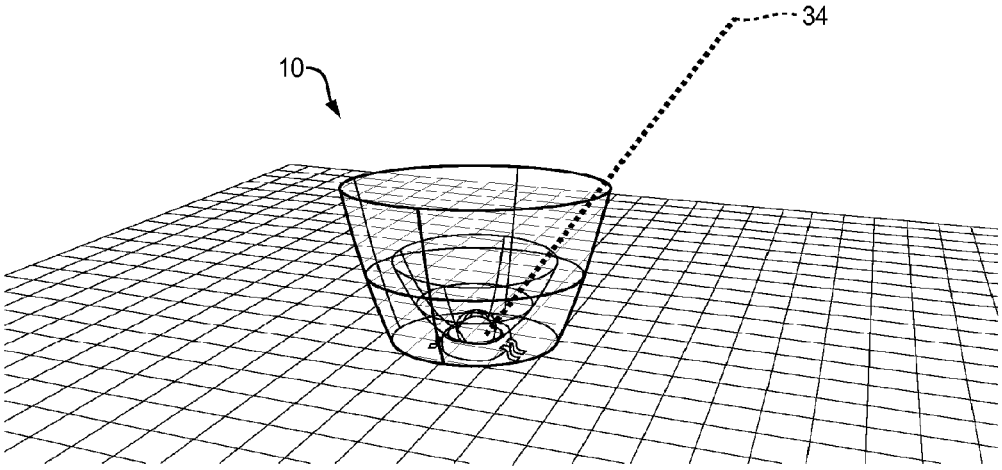
FIG. 3 schematically depicts the lighting system of FIG. 1 in a fully retracted position.
Figure 12:
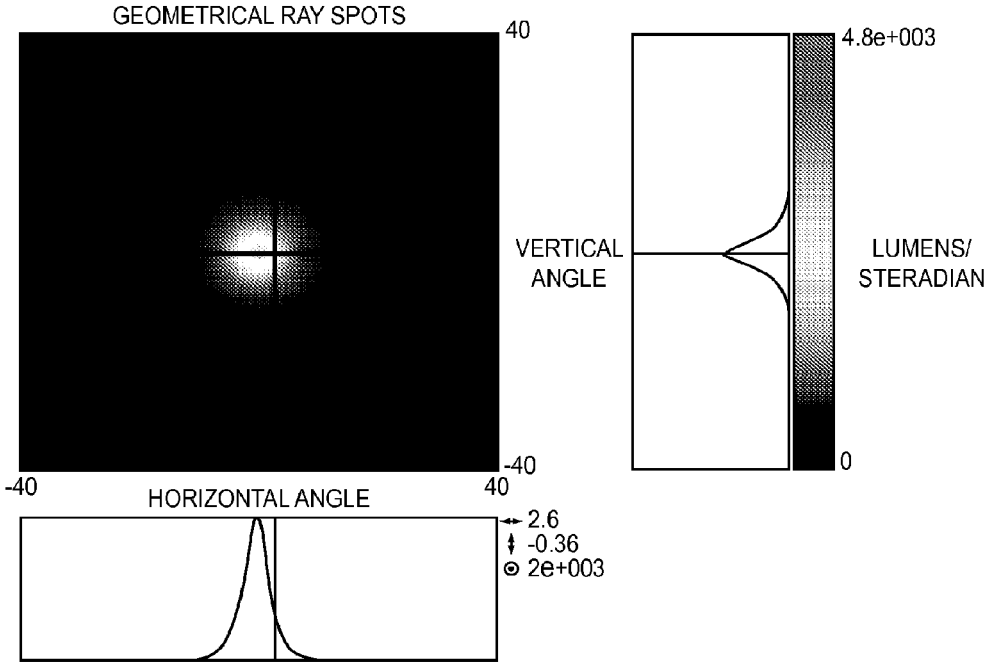
FIG. 12 illustrates an exemplary light pattern projected by the lighting system of FIG. 9 while in an extended (narrow) position onto a target surface and includes a graph depicting variation of light level on the target surface along a horizontal dimension and vertical dimensions.

Turning to FIGS. 1-3, in one implementation of the above embodiment, an exemplary lighting system 10 can include a plurality of reflectors (as shown, an inner reflector 1 and outer reflector 14) which can be mounted coaxially along an axis 16 (the axis 16 being designated in FIG. 12 by the dotted line and herein also referred to as optical axis). The inner reflector 12 can have a proximal end 28 adapted to receive light from a light source 18 and a distal end 26 through which the light exits the reflector 12. Similarly, the outer reflector 14 can have a proximal end 24 adapted to receive light (e.g., directly from a light source or via reflection from the inner reflector) and a distal end 30 through which the light exits the reflector 14. A light source 18 can be disposed along the axis 16 and can be optically coupled to the inner reflector 12, e.g., attached and/or otherwise coupled to the inner reflector. It should be understood that in other embodiments, the light source 18 need not be on-axis but can be offset (for example, a light source with a plurality of light emitting diodes can be used, some or all of which may not be on-axis). Further, in some implementations, the light source is not physically coupled to any of the reflectors, and can be only optically coupled to them (that is, the light from the source enters the light system via at leas one of the reflectors).

The inner and outer reflectors 12, 14 can be movable or adjustable relative to one another, as shown in the progression from FIG. 1 (showing an extended position, in which the outer reflector 14 can abut or partially overlap the inner reflector 12 along the axis 16) to FIG. 2 (showing an intermediate position in which the outer reflector 14 has been moved proximally relative to the inner reflector along the axis 16) to FIG. 3 (showing a retracted position, in which the outer reflector 14 again has been moved proximally relative to the inner reflector 12 along the axis 16). The relative movement of the reflectors 12, 14 can vary the illumination pattern produced on a target surface. In the illustrated embodiment, in the extended position the lighting system 10 can produce a relatively narrow beam (e.g., with a narrow divergence, relative to the retracted position). In some embodiments the extended position can produce an illumination pattern with a central bright spot surrounded by a diffuse annular region. In the retracted position, the lighting system 10 can produce a relatively wide beam (e.g., relative to the extended position). In some embodiments, the retracted position can produce a central bright spot surrounded by a diffuse annular region, although the bright spot and/or the annular region may have a wider diameter than in the extended position. In other embodiments (depending for example on the reflector characteristics and the relative position of the reflectors chosen for the "retracted" position), the retracted position can produce a relatively uniform illumination area (with no central bright spot).

The inner and outer reflectors 12, 14 can have a variety of shapes, but in some embodiments, the inner and outer reflectors can be conoidal (for example, they can be shaped like a cone and/or have a two-dimensional profile that is a conic section, such as a parabola, cone, ellipse, etc.). In many embodiments, the reflectors can be paraboloids. In yet other embodiments, the inner and outer reflectors 12, 14 can be substantially U-shaped or V-shaped in profile. As shown in FIG. 1, in which the distal end 26 of the inner reflector 12 abuts proximal end 24 of the outer reflector 14 so that there is no overlap or substantially no overlap between the reflectors. In some cases, the inner and outer reflectors 12, 14 can be shaped such that when abutting they form a substantially continuous or uniform surface. However, such a feature is not necessary, as the inner and outer reflectors 12, 14 can be of the same, similar or different shapes.

In many embodiments, the inner and outer reflectors can be shaped and configured such that, for at least one position of the light source (e.g., the extended position, or others), the light (including both reflected and un-reflected light) exiting the inner reflector 12 exhibits a maximum angle of divergence that is greater than the maximum angle of divergence of light exiting the outer reflector. In some preferred embodiments, the relative ratio of the heights of the reflectors 12, 14 can be about 3.4:1 (the outer reflector 14 has the greater height) with an exit aperture diameter ratio of about 1.85:1 (with the inner reflector 12 having the greater diameter).

Figure 4:
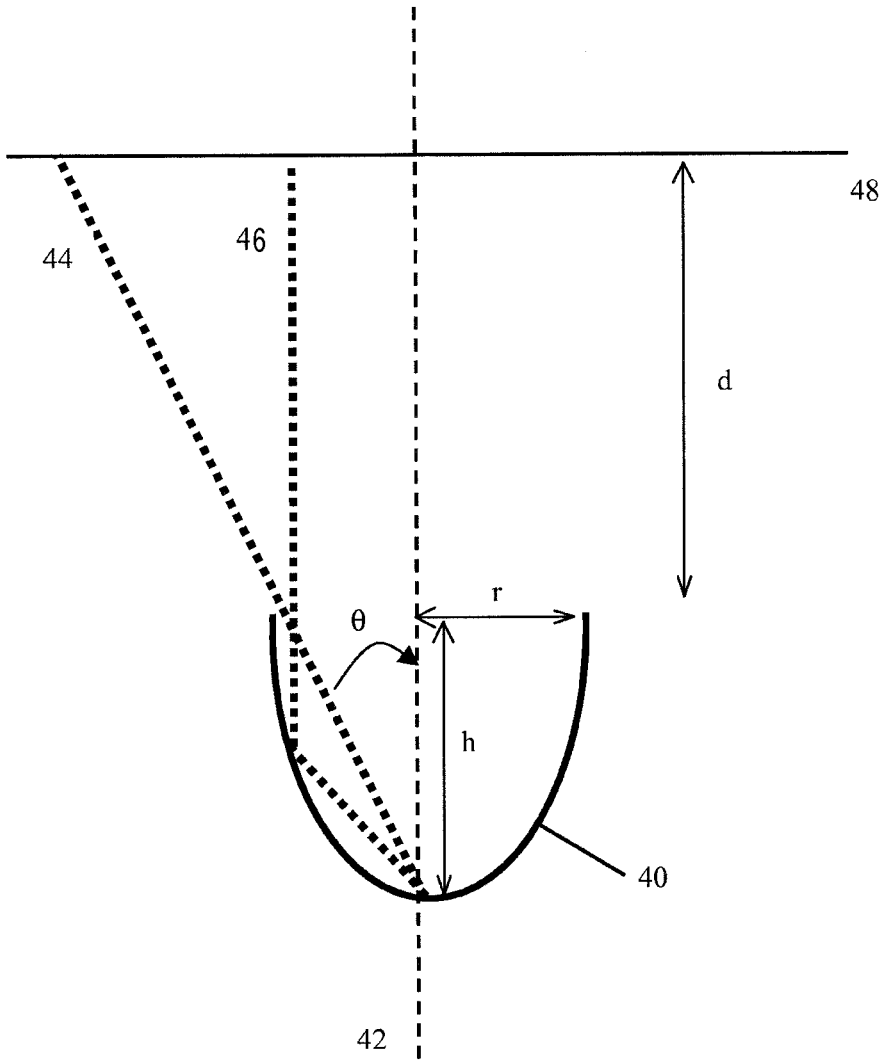
FIG. 4 is a schematic depiction of two light rays within an exemplary lighting system, one of the light rays undergoing a reflection before leaving a reflector of the lighting system and the other escaping the reflector without a reflection.

FIG. 4 shows an exemplary diagram illustrating the maximum divergence angle (represented by theta (θ)) as the maximum angle between the axis 42 (in this case, the optical axis of the reflector) and a light ray 44 at which the light ray 44 escapes a reflector 40 without reflection therefrom and is incident upon a target surface 48 at an arbitrary distance d. Light ray 44 represents a reflected ray of light which exhibits an angle of divergence less than the maximum angle of divergence. As shown, the light ray 46 leaves the reflector along a path substantially parallel to the axis 42. One skilled in the art will understand that this description of the divergence angle is merely to illustrate that the outer reflector 14 shown in FIG. 1 can produce a narrower spread of light than the inner reflector 12 and will also understand that the divergence angle can be characterized in a variety of ways, for example, it can be characterized as the arctangent of the radius of the exit aperture (r) divided by the height (h) of the reflector 40 along the axis 42 (assuming that reflected rays do not exceed this angle or ignoring reflected rays). The divergence angle can also be characterized by the maximum angle to the axis at which rays escape a reflector either with or without reflection.

In other embodiments, the outer and inner reflectors 12, 14, can reflect light at the same or a similar maximum divergence angle. In some embodiments, the outer reflector 14 is configured and positioned relative to the light source 18 so as to reflect the light from the source incident thereon in a collimated fashion for certain of its axial positions relative to the light source 18. For example, in the case of a parabolic outer reflector in an axial position at which the light source 18 is at a focal point of the paraboloid, the light rays reflected by the outer reflector 14 are substantially collimated.

The light source 18 can have a wide variety of locations, including both on-axis and off-axis locations, as previously mentioned. However, in many embodiments the light source can be attached to inner reflector such that it is disposed at a focal point thereof. In such a case, the light source can be also disposed at the focal point of the outer reflector for at least one position of the outer reflector, such as when the outer reflector is at the extended position. In other embodiments, the light source can be attached to the outer reflector so that it is disposed at a focal point thereof. Although shown as a light-emitting diode in FIGS. 1-2, the light source can be virtually any kind of light source, including incandescent light sources, fluorescent light sources, and so on.

Returning again to FIGS. 1-3, in the extended position shown in FIG. 1, light can exit the inner reflector 12 at an angle equal or less than a first maximum divergence angle. Light can exit the second reflector 14 at an angle equal or less than second maximum divergence angle that is smaller than the first divergence angle. In many embodiments, the outer reflector 14 can thereby reflect at least some of the light exiting the inner reflector 12 into a narrower solid angle (narrower divergence cone), thereby concentrating at least some of the light. By way of illustration, exemplary ray trace 20 illustrates a light ray exiting the light source and escaping both the inner and outer reflectors 12, 14 without reflection therefrom. In contrast, exemplary ray trace 22 illustrates a light ray exiting the light source 18 and being reflected towards the axis 16 by the outer reflector 14.

The illumination pattern produced in such an extended position can have a central bright spot surrounded by a diffuse annular region of light. In some cases, the central bright spot can be produced at least in part by the light reflected by the outer reflector 14 (again, by light reflected so as to have a smaller divergence), while the annular region can be produced at least in part by the light escaping the inner and outer reflectors 12, 14 without reflection therefrom.

As previously mentioned, the inner and outer reflectors 12, 14 can be adjusted to an exemplary intermediate position shown in FIG. 2. In this intermediate position, some light rays exiting the inner reflector 12 without reflection, which in FIG. 1 were reflected from the outer reflector 14, now exit from the outer reflector 12 without reflection. As a result, the light beam can have a wider divergence angle than that produced in the extended position of FIG. 1, and can produce a wider light pattern on a target surface than a respective pattern produced in the extended position of FIG. 1. Depending on the desired configuration, a central bright spot can still be produced. Exemplary ray trace 32 illustrates a light ray exiting the light source 18 and exiting both the inner and outer reflectors 12, 14 without reflection therefrom.

Further, the inner and outer reflectors can be adjusted to the retracted position shown in FIG. 3. In this retracted position, the outer reflector can be positioned such that less light (or in some embodiments essentially no direct light) from the light source is reflected therefrom, so that light is primarily or solely reflected from the inner reflector. As shown, the resulting light beam can in some embodiments have a wider divergence than that of FIGS. 1 and 2. Exemplary ray trace 34 illustrates a light ray exiting the light source 18 and exiting both the inner and outer reflectors 12, 14, without reflection therefrom.

The relative dimensions of the inner and outer reflectors 12, 14 can vary widely. However, in many embodiments, the width or diameter of the opening of the outer reflector 14 at its proximal end 24 can be sized such that inner reflector 12 can be received therethrough to allow the inner and outer reflectors 12, 14 to move in a telescopic fashion, as illustrated by FIGS. 1-3. In FIG. 3, the outer reflector 14 is shown as having a larger height than the inner reflector 12, where height is the distance along the axis 16 between proximal and distal ends of a reflector (e.g., axial distance between proximal and distal ends 30, 24, and axial distance between proximal and distal ends 26, 28). However, in many embodiments, the outer reflector 14 can be the same height or a smaller height than the inner reflector 12 so that in the retracted position the distal end 30 of the outer reflector can be withdrawn behind the proximal end 34 of the inner reflector, thereby allowing the inner reflector 12 to act without influence from the outer reflector 14 in controlling the light from the light source 18. In some preferred embodiments, the relative ratio of the heights of the reflectors can be about 3.4:1 (the outer reflector has the greater height) with a diameter ratio of about 1.85:1 (with the inner reflector having the greater diameter).

As previously mentioned in connection with FIG. 4, the divergence angle theta can be represented as the arctangent of the radius of the exit aperture (r) divided by the height (h) of the reflector 40 along the axis 42 and therefore the ratio of height and exit aperture diameter (also referred to as an aspect ratio) of a reflector can be selected to create the desired divergence angles, and, accordingly, beam spread and light pattern. The following table provides exemplary metrics for the inner and outer reflectors as ratios. For example the ratio of diameters represents the ratio of the diameter of the distal ends (exit apertures) of the inner and outer reflectors, with the outer reflector being larger. The ratio of heights represents the ratio of height, e.g., along a common axis, for the inner and outer reflectors, with the outer reflector being larger. The zoom travel indicates the total displacement in moving from the fully retracted to the fully extended positions.

| System | Ratio Diameters | Ratio Heights | Zoom travel |
|---|---|---|---|
| Small System | 1.5:1-2.5:1 | 1.2:1-3.0:1 | 8-15 mm |
| Medium System | 1.5:1-4.0:1 | 1.2:1-3.5:1 | 10-20 mm |
| Large System | 2.0:1-5.0:1 | 1.2:1-4.0:1 | 12-30 mm |

It should be understood that the parameters listed above are merely provided as illustrations of designs and are not intended to necessarily show optimal results that can be achieved or that need to be achieved by employing a lighting system in accordance with the teachings of this application.

It should be understood that the relative positions designated as "extended", "intermediate", and "retracted" in connection with FIGS. 1-3 are for illustrative purposes. For example, in some embodiments, the outer reflector 14 may be spaced apart from the inner reflector 12 in an extended position. In other embodiments, in a retracted position the outer reflector 14 may remain distal to the inner reflector 12 and reflect some light from the light source 18. Further, it should be understood that the inner and outer reflectors 12, 14 can be adjusted in a continuous range between an "extended" and a "retracted" position, or can be adjustable amongst a plurality of indexed or selectable discrete positions. Also, additional reflectors can be added, and indeed any number of reflectors can be used, which may provide for larger or more dramatic changes in illumination spot sizes or other attributes.

In some embodiments, the inner and the outer reflectors 12, 14 are configured and the light source 18 is positioned relative to the reflectors such that in a fully retracted position, the lighting system 10 can generate an output illumination area (e.g., on a target surface) across which the light intensity level is highly uniform. In many embodiments, the illumination area can be characterized by the illuminated target surface area bounded by rays exiting the lighting system at a maximum divergence angle (e.g., the maximum angle at which rays can exit without reflection) to the optical axis. Such rays can characterize a solid angle extending from the light source and being subtended by the illumination area. For example, the ratio of maximum to minimum light intensity level across the illumination area when the reflectors are in a fully retracted position can be equal or less than about 2:1, preferably about 1.3:1 or less, in some cases about 1.2:1 or less, and in some cases the ratio can be about one. As the reflectors 12, 14 are transitioned from the fully retracted position to the fully extended position, the lighting system 10 directs progressively more of the light to a central spot within the illumination area. In some embodiments, in the fully extended position, the ratio of maximum to minimum light intensity level across the illumination area (e.g., from a central point to a peripheral point) can be equal to or greater than about 10:1, or about 20:1, or about 30:1. Further, a normalized uniformity can be defined as the ratio of maximum and minimum light intensity where:

$$NormalizedUniformity = \frac{(\max - \min)}{\max}$$

As one of ordinary skill in the art will understand, the above-recited uniformity ratios (e.g., 2:1 in a retracted position and 10:1 in an extended position) generally can be expressed as a normalized uniformity between 0 and 1. For example, if max=1 and min=1, then the normalized uniformity is 1, while if max=2 and min=1, then the normalized uniformity is 0.5, and if max=10 and min=1, then the normalized uniformity is 0.9.

In some implementations, in the retracted position, the reflectors are sized and the light source is positioned relative the proximal end of the inner reflector such that a substantial portion of the light emitted by the source (e.g., more than about 80% or preferably more than about 90% and in some cases 100%) that enters the inner reflector exits the distal end of the outer reflector without undergoing any reflections by the outer reflector, and in many cases without undergoing any reflections by the inner reflector either. In other words, a substantial portion of the light emitted by the source can be directly projected onto a target surface.

A wide variety of adjustment mechanisms can be used to move the reflectors relative to one another. Preferably, the relative movement of the reflectors is along a common axis, as depicted in FIGS. 1-3. A screw thread mechanism can be provided such that the outer and inner reflectors (and/or light source) rotate radially about the axis during adjustment. In other embodiments, the inner and outer reflectors can be attached to separate support assemblies which are configured to slide axially relative to one another. Furthermore, the adjustment mechanism can be manipulated by a user during operation of the lighting system to adjust the relative position of the outer and inner reflectors so as to vary the output illumination pattern of the lighting system. For example, a user might twist a portion of a flashlight to actuate the adjustment mechanism, or in other embodiments might push or slide a tab or button to actuate the adjustment mechanism in order to cause such movement. The adjustment mechanism also can be driven by a motor under the control of a user. As previously mentioned, in some embodiments, the adjustment mechanism can adjust the relative position of the reflectors over a continuous range. In other embodiments, the adjustment mechanism can provide any number of discrete, indexed positions.

Figure 5:
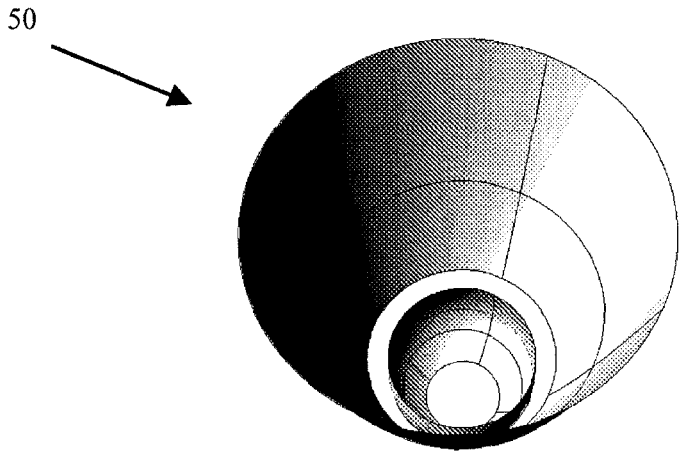
FIG. 5 is a schematic perspective view of an exemplary lighting system according to another embodiment of the invention.
Figure 6:
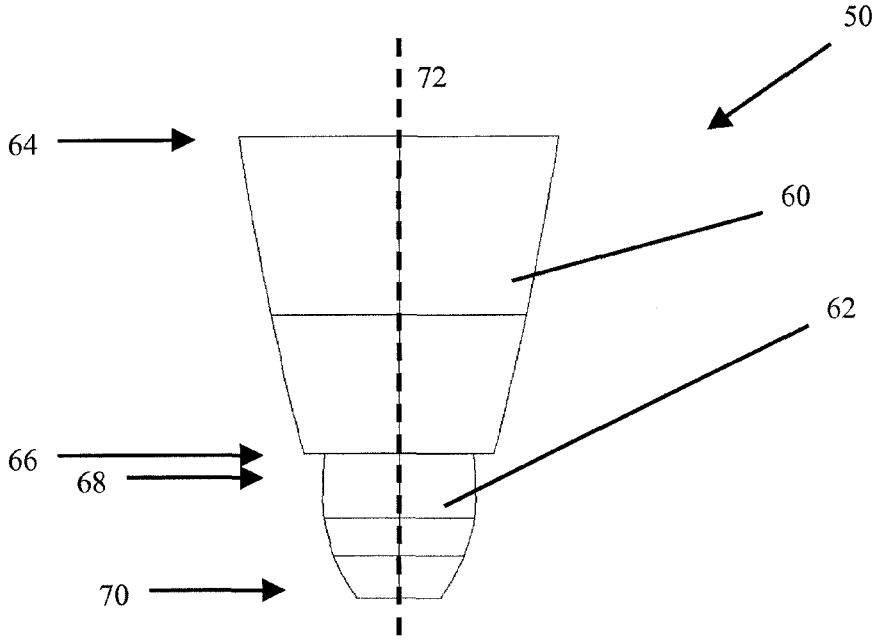
FIG. 6 is a schematic side view of the lighting system depicted in FIG. 5.
Figure 7:
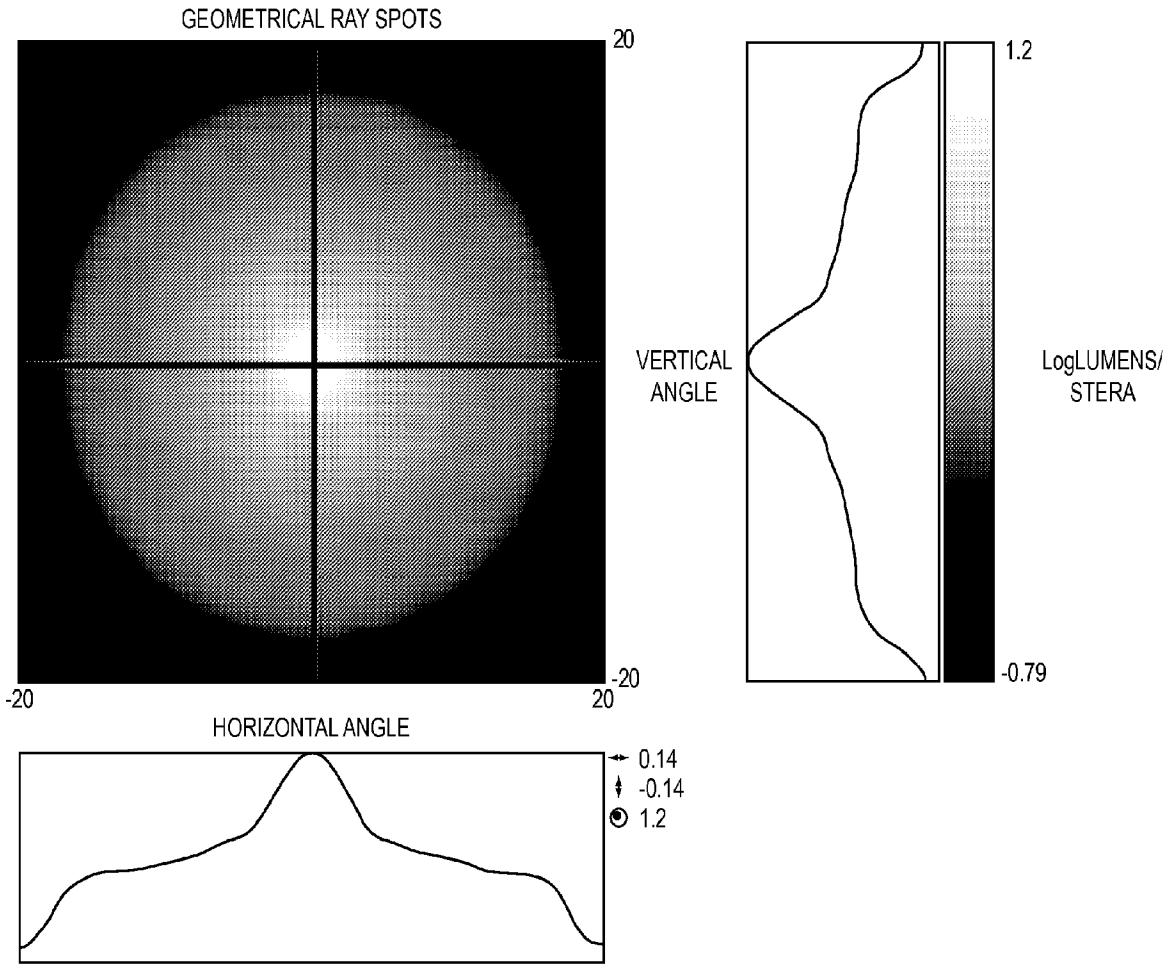
FIG. 7 illustrates an exemplary light pattern projected by the lighting system of FIGS. 5-6 while in an extended (narrow) position onto a target surface and includes a graph depicting variation of light level on the target surface along a horizontal dimension and vertical dimensions.
Figure 8:
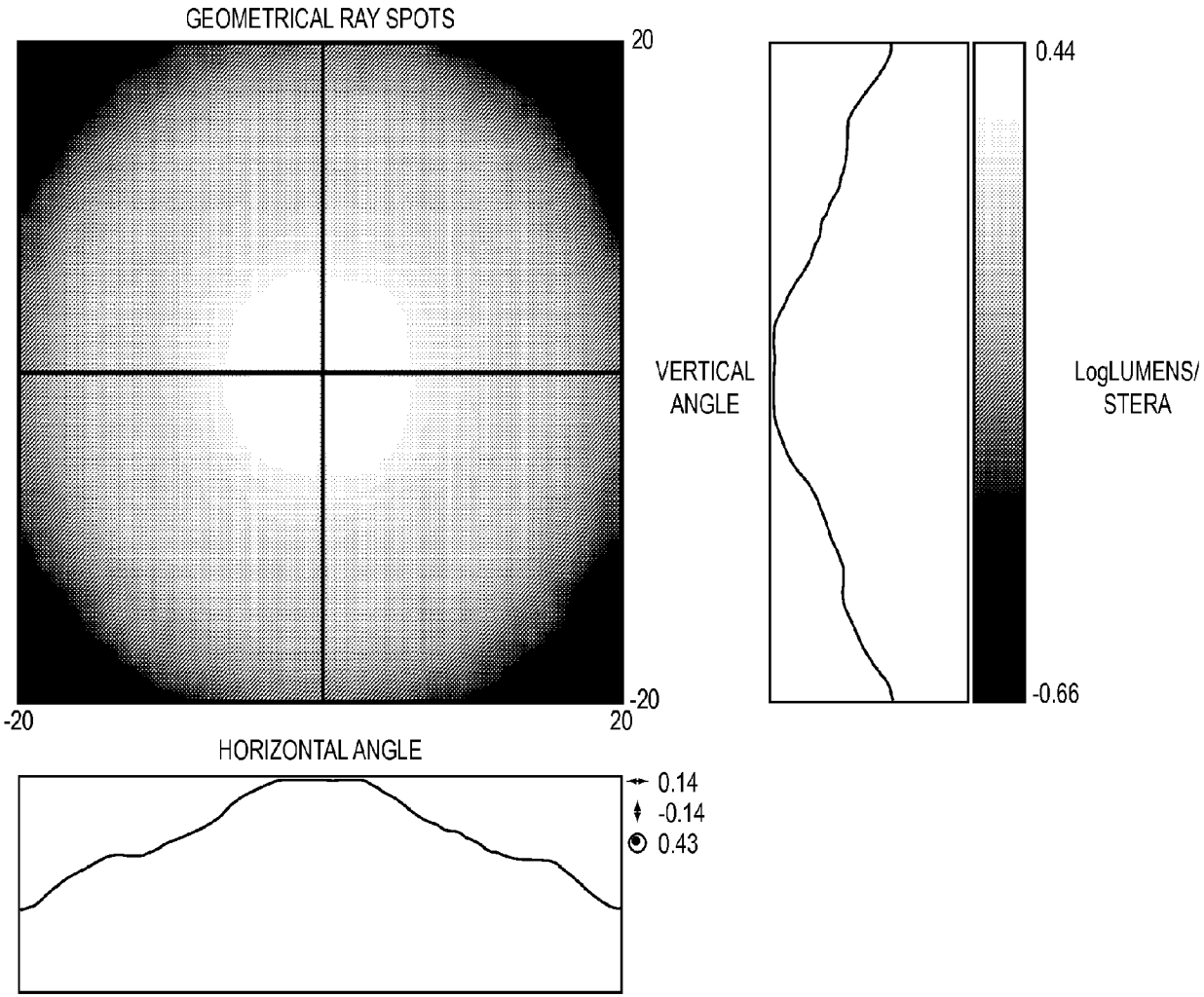
FIG. 8 illustrates an exemplary light pattern projected by the lighting system of FIGS. 5-6 while in an retracted (wide) position onto a target surface and includes a graph depicting variation of light level on the target surface along a horizontal dimension and vertical dimensions.

FIGS. 5-6 show another exemplary embodiment of a lighting system 50 which includes an outer reflector 60 and an inner reflector 62 disposed along an axis 72. In this embodiment, the outer reflector 60 can be a paraboloid. The inner reflector 62 can be generally U-shaped, and also can be conoid. In many embodiments, the shape of the inner reflector 62 may be parabolic or elliptical but also can be optimized for specific flood light pattern requirements. FIGS. 7A through 8B depict exemplary light spots and illumination profiles that can be produced by the exemplary lighting system 50 of FIGS. 5-6 with a light source fixedly attached to the inner reflector 12. FIG. 7 corresponds to an extended position as shown in FIGS. 5-6, in which a light source is disposed at the focal point of the outer reflector, in which the light spot exhibits an angular extent of 5 degrees full width at half-maximum (FWHM). The graphs on FIG. 7 depict the light intensity (log lumens) vs. angle along a horizontal extent of 40 degrees (from −20 to 20 degrees) and the light intensity vs. angle along a vertical extent of 40 degrees. FIG. 8 corresponds to a retracted position in which the outer reflector 60 is withdrawn proximally along axis 48 such that the proximal end 66 of the outer reflector 60 is proximal to the distal end 68 of the inner reflector 12, in which the light spot exhibits 18 degrees FWHM. The graphs on FIG. 8 depict the light intensity (log lumens) vs. angle along a horizontal extent of 40 degree and the light intensity vs. angle along a vertical extent of 40 degrees.

Figure 9:
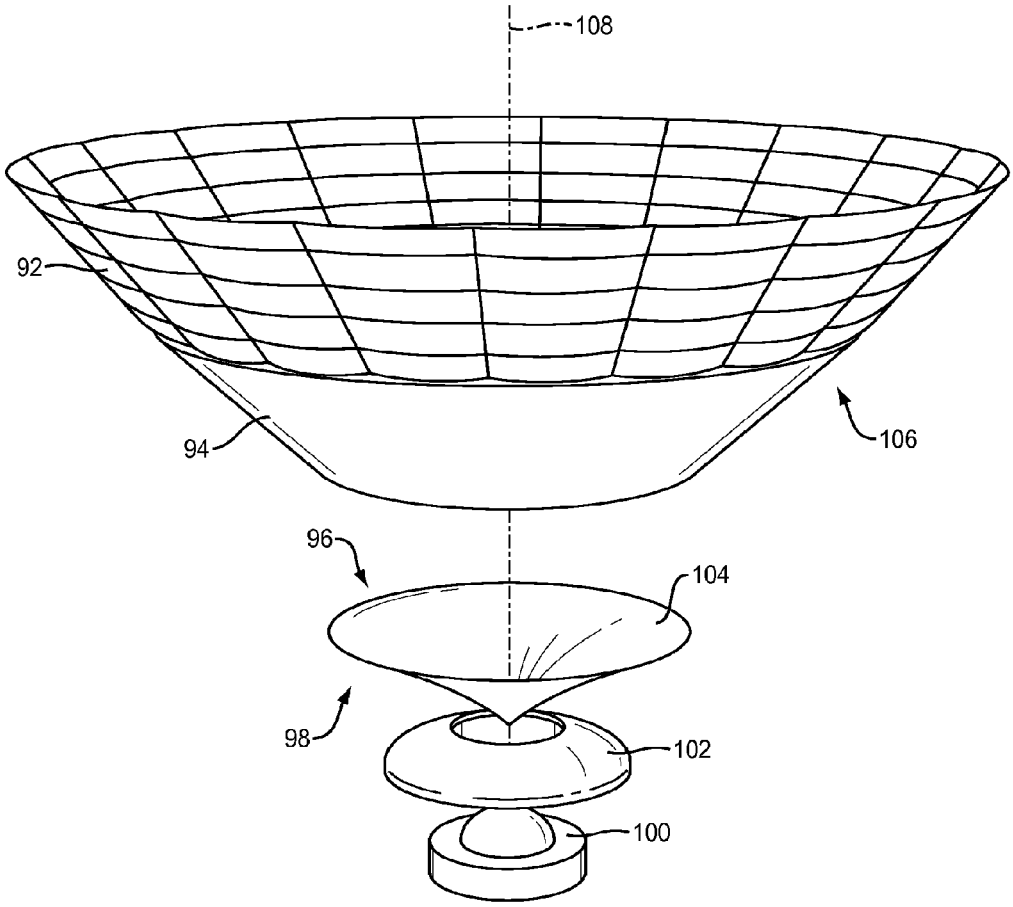
FIG. 9 is a schematic exploded view of various optical components of an exemplary lighting system according to another embodiment of the invention.
Figure 10:
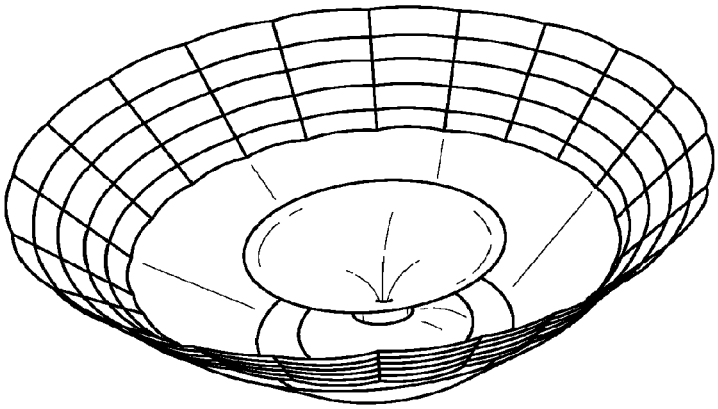
FIG. 10 is an assembled view of the lighting system of FIG. 9 which schematically depicts the relative position of the two reflectors in a retracted position.
Figure 11:
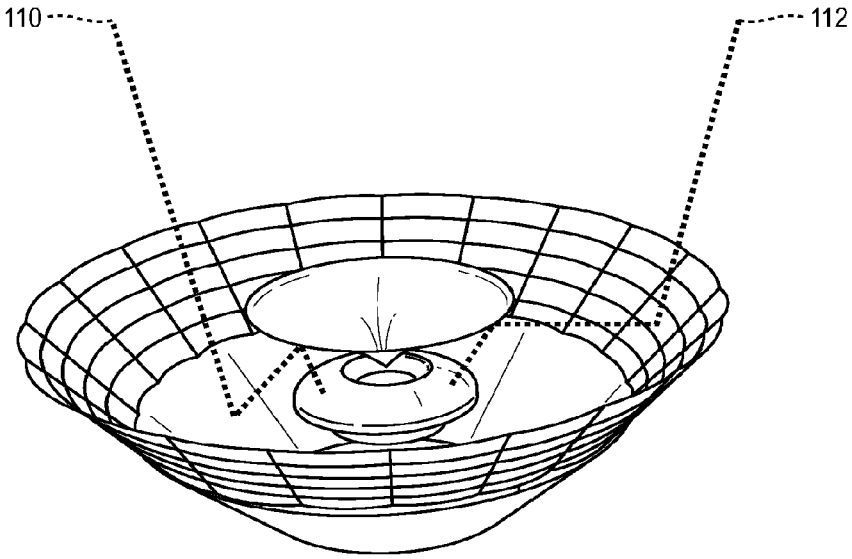
FIG. 11 is an assembled view of the lighting system of FIG. 9 which schematically depicts the relative position of the two reflectors in an extended position.

FIG. 9 shows another exemplary embodiment of a lighting system 90 which includes an outer reflector 106, an inner reflector 104, a lens 102, and a light source 100, all disposed coaxially along axis 108. FIG. 9 is an exploded view of these components, while FIGS. 10-11 show assembled views. As shown, in some embodiments, the light source 100, lens 102, and/or inner reflector 104 essentially can be disposed within the outer reflector 106 (at least in some positions). The outer reflector 106 can have a conical profile, e.g., the reflector can be a paraboloid, or other conoid (and/or generally can have a U-shaped or V-shaped profile). The outer reflector 106 can have a smooth and/or polished portion 94 and a faceted portion 92. The faceted portion can provide several advantages, such as spatial mixing of the source light where the source light has non-uniform structure, decreasing the sensitivity to manufacturing tolerances and providing an interesting aesthetic. Facets can be flat or have a curve of any shape. In many embodiments, facets can be flat or can be sectioned to follow, or approximate, the general profile of the reflector 106 (e.g., a non-faceted portion such as portion 94). Facets also can be sections that have either a convex or concave local profile providing a desired flood light pattern. In some embodiments, faceted portions can be asymmetric, e.g., rotationally or axially, such that movement of the reflector (e.g., rotationally or axially relative to the light source) can vary the illumination pattern produced by the faceted portion and ultimately the lighting system. In some embodiments, such varying illumination patterns produced by a faceted portion can be combined with a central bright spot (produced, for example, with a smooth portion of the same or another reflector) and can have advantageous aesthetic or utilitarian effects. It should be understood that, while illustrated with FIGS. 9-11, facets can be included in any of the embodiments described herein.

The inner reflector 104 generally can have a tapered shape, (and/or can be conoidal, as mentioned previously) and can have anterior and posterior surfaces 96, 98. At least the posterior surface 98 can be configured to reflect light therefrom. The lens 102 can have a wide variety of shapes, but as shown the lens 102 can be configured to receive light from the light source 100 and to pass or couple such light to the inner reflector 104. The lens 102 can be formed from polycarbonate or any of a wide variety of materials.

In use, as illustrated by an exemplary ray trace 110 in FIG. 11, light from the light source 100 can be received by the lens 102, and can be refracted at an entry surface and exit surface thereof to be incident on a posterior surface 50 of the inner reflector 104. The light can be reflected from the posterior surface 50 of the inner reflector towards the outer reflector 106. The light can be reflected from the outer reflector 20 and exit the lighting system 90 to be incident on a target surface. Exemplary ray trace 112 illustrates that light can be reflected from the faceted portion 92. In some embodiments, for a given relative position of the reflectors/lens/light source, light reflected from the smooth portion 94 can create a relatively narrow light pattern, while light reflected from the faceted portion 92 can create a relatively wide light pattern (relative to one another).

Figure 13:
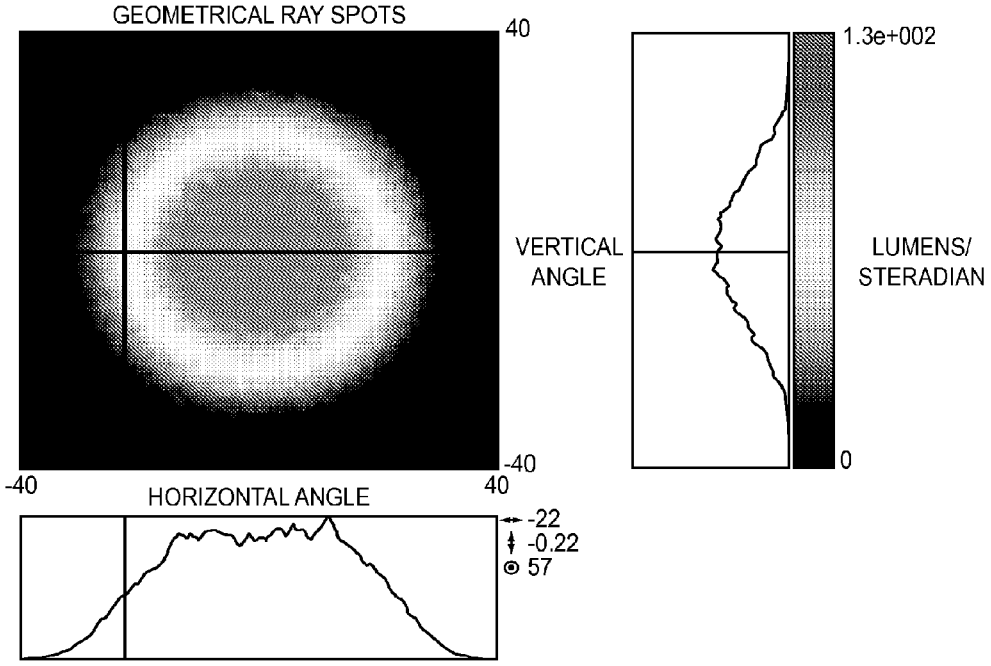
FIG. 13 illustrates an exemplary light pattern projected by the lighting system of FIG. 9 while in an retracted (wide) position onto a target surface and includes a graph depicting variation of light level on the target surface along a horizontal dimension and vertical dimensions.

Further, in many embodiments, the outer reflector 106 can be movable or adjustable relative to an assembly of the inner reflector 104, lens 102, and light source 100, which can be fixedly attached to one another. (It should be understood, however, that any of the components can be movable or adjustable relative to one another depending on the desired adjustment mechanism and illumination characteristics.) FIGS. 10-11 show exemplary positions of the outer reflector 106 relative to the inner reflector 104, with FIG. 10 corresponding to a "close" or "narrow" position (relative to FIG. 11) and FIG. 11 corresponding to a "far" or "wide" position (relative to FIG. 10). The distance corresponding to the displacement of the outer reflector between such positions can vary widely, but as shown can be about 13 mm. A typical range of displacement can be about 8 mm to about 25 mm. FIGS. 12-13 illustrate exemplary light spots that can be produced by the lighting system shown in FIGS. 10-11. FIG. 12 corresponds to the "narrow" position of FIG. 10 and shows a light spot with an on-axis efficiency of about 48 candelas/lumen. FIG. 12 includes two graphs which plot the intensity vs. angle for a horizontal extent of 80 degrees and for a vertical extent of 80 degrees. FIG. 13 corresponds to the "wide" position of FIG. 11 and shows a light sport with an on-axis efficiency of about 1.3 candelas/lumen. FIG. 13 includes two graphs which plot the intensity vs. angle for a horizontal extent of 80 degrees and for a vertical extent of 80 degrees. As previously mentioned, a variety of different light sources can be utilized; however the exemplary data shown in the FIGS. 12 and 13 was developed using a Cree XR White LED; 100 LM flux; 83% reflectance.

Figure 15:
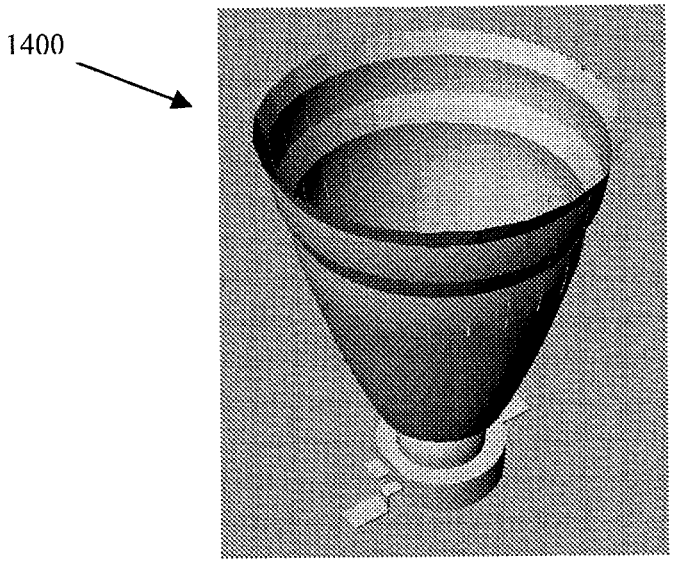
FIG. 15 is a three-dimensional schematic rendering of the lighting system of FIG. 14A.
Figure 16:
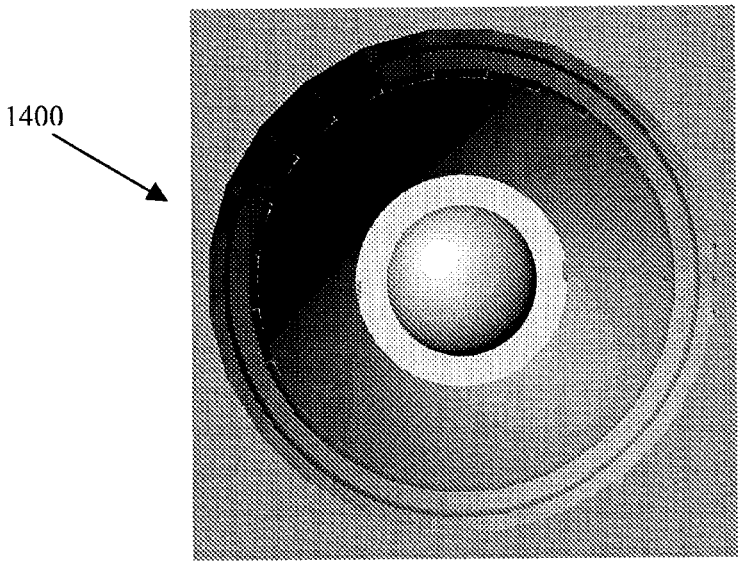
FIG. 16 is another three-dimensional schematic rendering, in a top view, of the lighting system of FIG. 14A.

It should be understood that while for descriptive purposes many of the foregoing embodiments have included two reflectors, virtually any number of reflectors can be used. For example, FIG. 14 shows another exemplary embodiment of a lighting system 1400 which includes one reflector 1402 disposed about an optical axis 1404. The reflector can have a proximal end 1406 adapted to receive light from a light source (e.g., light source 1410, here shown as an LED) and a distal end 1408 through which light exits the reflector 1402. As shown in the three-dimensional renderings of FIGS. 15-16, the reflector 1402 can be rotationally symmetric about the axis 1404, although this is not necessary.

Figure 14A:
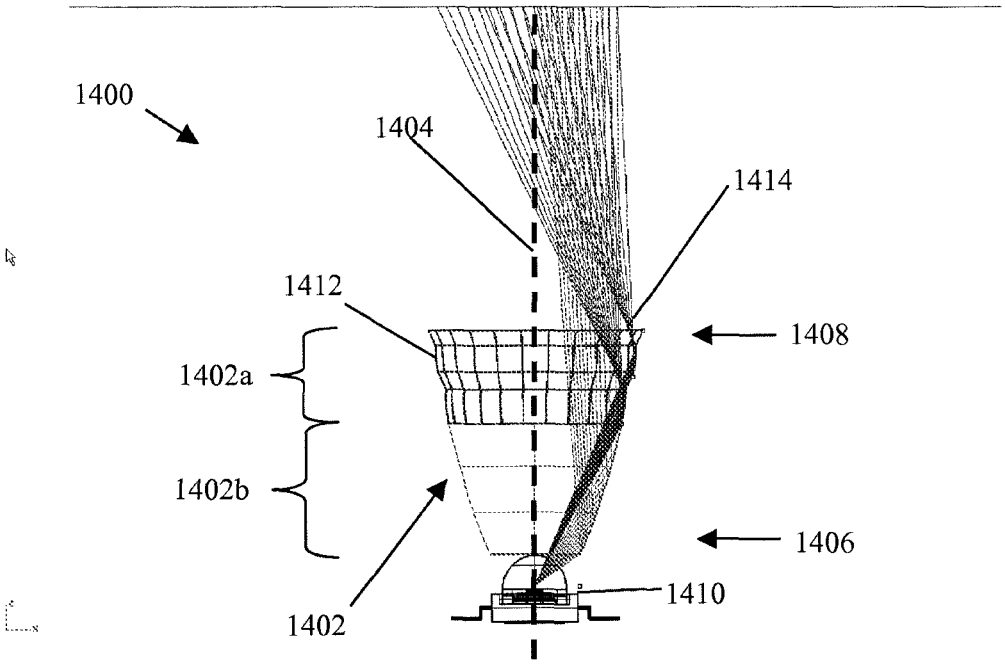
FIG. 14A schematically depicts a lighting system according to another embodiment of the invention.
Figure 14B:
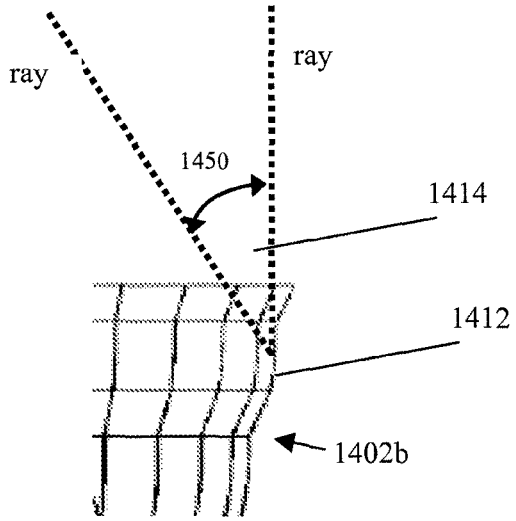
FIG. 14B schematically depict two rays leaving the lighting system of FIG. 14A, where one ray is substantially parallel to the optical axis and the other ray is reflected at a maximum angle.

As shown in FIG. 14A, the reflector 1402 can have two reflective regions 1402*a*, 1402*b*. In many embodiments, the proximal region 1402*b* can serve to collect or collimate at least a portion of the light emitted from the light source and incident thereon and to produce a light spot (e.g., on a target plane). The proximal region 1402*b* can be smooth and can generally U or V shaped and/or can have a parabolic profile, or in some cases the profile of another conic section.

In many embodiments, the inner surface of distal region 1402*a* can be adapted to produce a flood beam on a target plane, which can be wider (e.g., on the target plane) than the light spot produced by collimated or collected light from the proximal region 1402*a*. In many cases, for a given position of the light source 1410 (e.g., the light source 1410 can be disposed at a focal point of reflector region 1402*b*), the maximum divergence angle between the axis 1404 and a light ray reflected from region 1402*a* can be greater than that of the maximum divergence angle between the axis 1404 and a light ray reflected from region 1402*b*.

For example, the distal region 1402*b* can have a generally parabolic or other shape and can be faceted. Each of a plurality of facets 1412 can redirect at least a portion of light incident thereon into an angular region 1414. In many embodiments, the angular region 1414 can extend from a ray that is substantially parallel to the optical axis 1404 to another ray which is reflected at maximum angle (e.g., a chosen angle depending on the desired illumination characteristics), which is shown in more detail with arrow 1450 in FIG. 14B. The superposition of light reflected from each facet 1412 can produce a uniform light distribution on a target plane. Each facet 1412 can be rectangular, square, circular, elliptical, or virtually any other shape. Any number of facets can be used.

In use, for a given position of the light source 3510, light reflected from proximal reflective region 1402*b* can be directed into a central bright spot on a target surface, while light reflected from distal portion 1402*a* can produce a substantially uniform light distribution on the target surface (e.g., from the superposition of reflected rays as previously described), which can illuminate an area larger than the central bright spot.

The light source 1410 and/or the reflector 1402 can be moved along axis 1404 to change their relative axial positions and thereby vary the light pattern produced. By way of illustration, in some embodiments the light source 1410 can initially be disposed as shown in FIG. 56 (e.g., in an extended position of the reflector 1402), which, for example, may represent the light source 1410 being at a focal point of the reflector region 1402*b*. As the position of the light source 3510 relative to the reflector 1402 is changed from that shown in FIG. 17 to the one shown in FIG. 18 (e.g., to a retracted position of the reflector 1402), less light can be reflected from the proximal region 3502*b*, thereby reducing the intensity of the central bright spot and/or making the light pattern relatively wide (e.g., relative to the light pattern produced by the light source 3510 before the position change).

Figure 17:
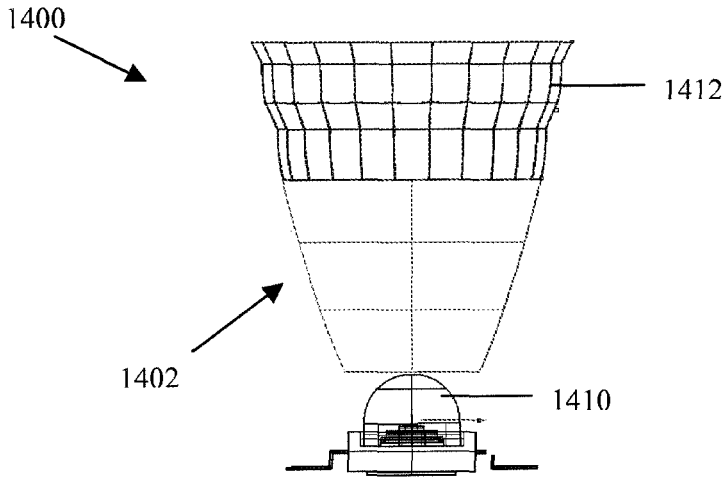
FIG. 17 shows the lighting system of FIG. 14A in an extended position.
Figure 18:
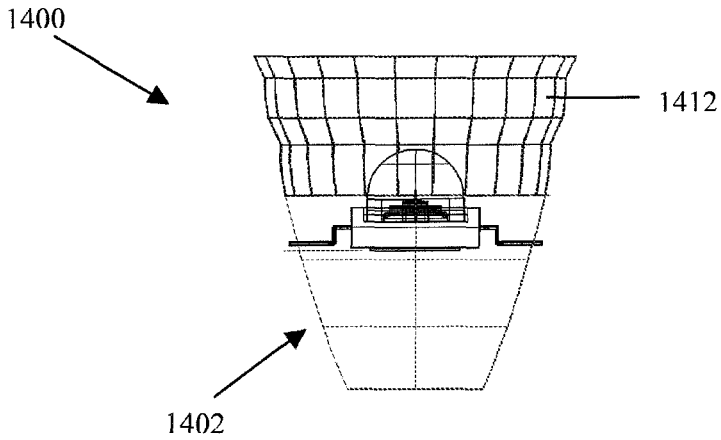
FIG. 18 shows the lighting system of FIG. 14A in a retracted position.

Conversely, as the position of the light source 3510 relative to the reflector 1402 is changed from FIG. 18 to FIG. 17, progressively more light can be reflected from the proximal region 1402*b*, thereby increasing the intensity of the central bright spot and/or making the light pattern relatively narrow (e.g., relative to the light pattern produced by the light source 3510 before the position change). Exemplary light patterns are shown in connection with Example 4, below. The reflector 1402 and/or light source 1410 can be coupled to an adjustment mechanism, as previously described, for varying their relative axial positions.

The relative sizes of the regions 1402*a* and 1402*b* along the axis 1404 (e.g., their relative lengths along the axis 1404) can be adjusted to proportion the amount of light reflected from the proximal and distal regions 1402*a*, 1402*b* and to thereby vary the light pattern produced for a given position of the light source 1410. For example, adjusting the relative sizes of the regions 1402*a* and 1402*b* can balance the peak luminance (e.g., at a given target distance) with the size and uniformity of the flood beam. In some embodiments, the ratio of the heights of the two regions can be in a range of about 2.5:1 to about 6:1 with the height ratio of about 3.4:1 being the preferred height in some implementations of the reflector.

Although FIGS. 17-18 illustrates a reflector 1402 with two reflective regions 1402*a* and 1402*b*, in other embodiments, additional regions can be included (e.g., intermediate regions transitioning from the first to second regions).

By way of further illustration, the following Examples 1-4 are provided. It should be understood that the information presented in connection with the Examples is provided for illustrative purposes and is not intended to necessarily show optimal results that can be achieved or that need to be achieved by employing a lighting system in accordance with the teachings of this application.

Example 1

Figure 19:
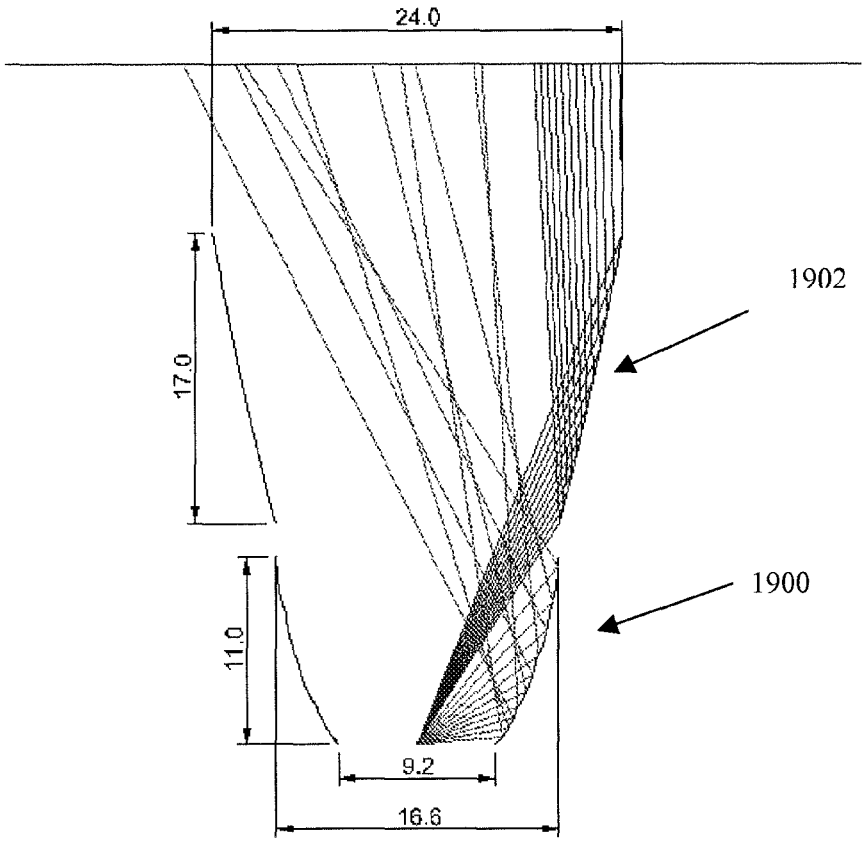
FIG. 19 is a schematic view of an exemplary lighting system made for Example 1.

For illustrative purposes, a prototype lighting system was fabricated with some similar features as those described in connection with the embodiments shown in FIGS. 1-3. FIG. 19 schematically shows the prototype lighting system, which was formed from an inner reflector 1900 and a coaxial outer reflector 1902. The interior surfaces of the inner and outer reflectors had faceted portions for improving the uniformity of the reflected light, although this is not necessary. The inner and outer reflectors were paraboloids and were formed of polycarbonate that was metallized via a vacuum aluminum metallization process, which can provide a reflectance of about 90% or greater for light of wavelengths of between about 400 nm-700 nm.

A Cree XR White LED (100 LM flux) was attached to the inner reflector such that it would be oriented at the focal point of the inner reflector and of the outer reflector when the outer reflector was in an extended position. The light source was fixedly attached to the inner reflector, and the inner and outer reflectors were mounted for relative co-axial movement. More specifically, the inner and outer reflectors were coupled so that the outer reflector could be moved relative to the fixed inner reflector and the LED. The outer reflector could overlap the inner reflector as it retracted. The travel distance of the outer reflector between the extended or narrow position and the retracted or wide position was about 15 mm. FIGS. 20 and 21 are images of exemplary "wide" and "narrow" illumination patterns, respectively, produced on a target surface with the lighting system shown in FIG. 19. FIG. 21 corresponds to the outer reflector in a retracted position, and shows a relatively wide spot (a flood spot) on a target surface (relative to that shown in FIG. 21). FIG. 21 corresponds to the outer reflector in an extended position, and shows a relatively narrow spot on the target surface with a central bright spot (again, relative to that shown in FIG. 20).

Example 2

A prototype two-reflector focusable lighting system based on the teachings of the invention was designed. FIGS. 22 and 23 schematically show the two reflectors in an extended an in a retracted position, respectively. The inner reflector was sized to allow for proper material thickness and clearance between the reflectors, and to allow the inner reflector to be positioned within the outer reflector when the reflectors are in a fully retracted position. As discussed below, this prototype lighting system exhibits an improved light intensity uniformity for the wide beam position corresponding to the retracted position of the two reflectors.

Figure 24:
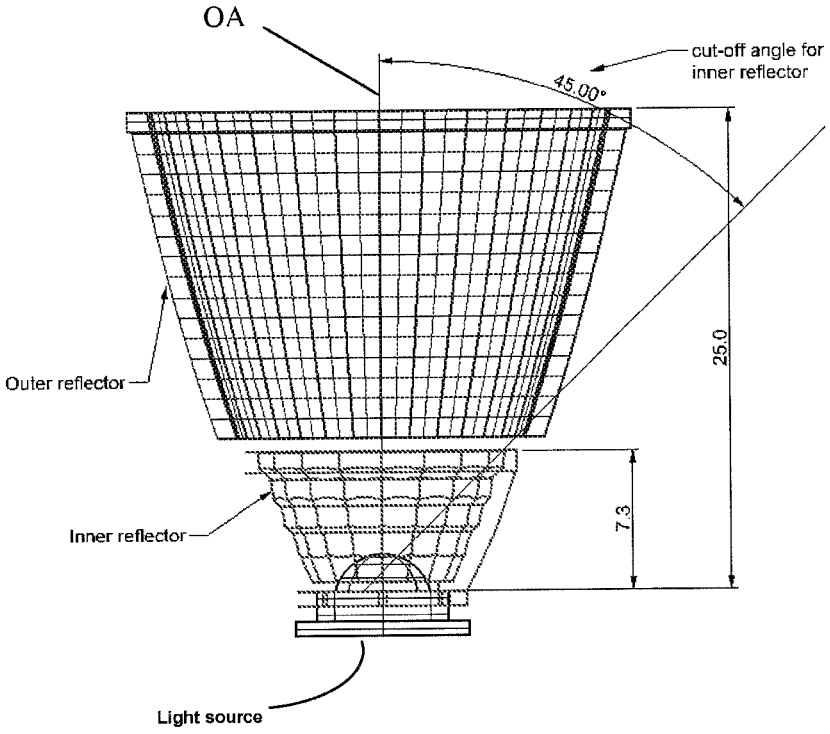
FIG. 24 is another schematic view of the lighting system designed for Example 2.
Figure 25:
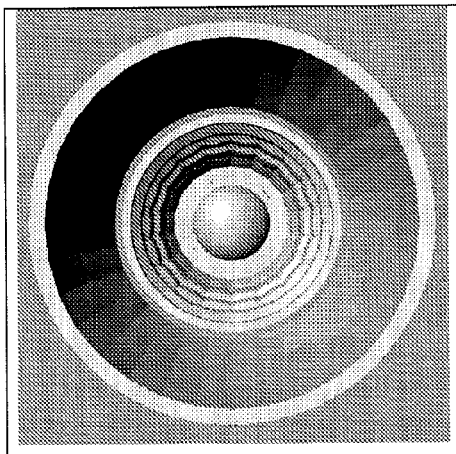
FIG. 25 is a perspective view of the lighting system designed for Example 2.
Figure 26:
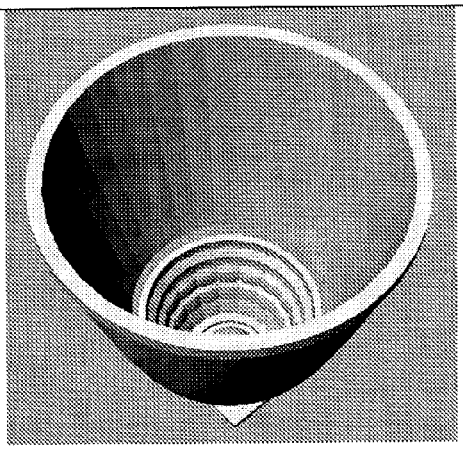
FIG. 26 is another perspective view of the lighting system as designed for Example 2.

FIGS. 24, 25 and 26 further schematically show the inner and outer reflectors of the prototype lighting system, which are movably disposed relative to one another about an optical axis OA. Some exemplary design parameters such as the heights of the reflectors (their extent along the optical axis) as well as the maximum divergence angle (cut off angle) of a light ray leaving the inner reflector without undergoing a reflection are also provided on FIG. 24. As shown in FIGS. 25 and 26, in this design the inner reflective surface of each reflector included a plurality of facets, although in other designs, facets can be included in only one of the reflectors or none of the reflectors. The reflectors were designed for high volume manufacturing suitable for a variety of applications, such as consumer, industrial and military applications. The mechanical design of the outer geometry was adapted for plastic injection molding processing.

Design Method/Details:

The Example 2 design was performed using the following steps:

Maximum reflector diameter of 27 mm was selected.

A light source was chosen (LED by Cree, Inc. marketed under trade designation XR-E 7090 was selected).

An optimized smooth parabolic shape was determined for the light distribution from the source.

The base shape optimization also included adjustment of the height and the chosen value was a balance between the maximum on-axis performance and overall dimension. The height ratio used was 5.0:1.

The base shape was cut into two different sections. The ratio of the split was ~3.4:1, where the larger section was the outer reflector. The outer reflector would then be indexed in or out to change the size and shape of the light distribution.

The next step was to design the smaller, inner reflector to produce uniform lighting over the angular region as defined by the cut-off angle from the edge of the reflector surface.

In practice, in many cases the light only from the inner reflector can be useful for reading a map or illuminating areas in close proximity. The outer reflector can be primarily used for illuminating objects at a distance.

The inner reflector underwent many design trials, to find a good, first design solution. FIGS. 27 and 28 show simulated paths of exemplary rays passing through the chosen two-reflector design when the reflectors are in a retracted position. As shown, in the retracted position, some rays emanating from the source pass through the inner reflector without undergoing any reflections while others are reflected by the reflective inner surface of inner reflector to exit the lighting system. In this implementation, in the retracted position, the light rays emanating from the source do not intersect with the outer reflector. In contrast, as shown in FIG. 29, in the extended position, some rays emanating from the source reach the reflective inner surface of the outer reflector, either directly or via reflection from the inner reflector. The rays reaching the reflective inner surface of the outer reflector are reflected at that surface and exit the lighting system to facilitate the formation of a central bright spot. In this implementation, a large portion of the light rays that are reflected from the inner reflective surface of the outer reflector are oriented substantially parallel to the optical axis of the system (an axis about which the two reflectors are disposed in a rotationally symmetric manner).

The base profile was divided into 5 sectors, called facets. Each facet had a square size and the shape of the geometry was chosen to spread the light evenly from near the axis (0 degrees) out to the full extent as defined by the edge ray of light. In this implementation, each "facet" was designed to redirect a portion of the light into a predefined angular region. In this implementation, the superposition of the light from each facet was designed to produce a uniform light distribution at the target plane.

After the optimization of the facet geometry for the inner reflector was complete, the outer reflector was further optimized by adding facets. More specifically, the base surface was segmented into individual rectangular facets with a feature size of about 2 mm by about 3 mm. These facets followed the basic parabolic profile and serve to add an interesting aesthetic and also to help with manufacturing tolerances by breaking up the projected light into smaller sectors. In this case, the facets can lead to a decrease of the on-axis performance ~10% but this is a good compromise to produce a more uniform projected beam. Also, in some cases, a nearly perfect smooth surface can show other artifacts that cannot be observed in the theoretical simulation.

The design process for the design of facets is described with additional detail in the Appendix to Example 2, below.

System Setup for Simulation of Example 2:

LED: Cree XR-E 7090 cool white

Flux normalized to provide on-axis efficiency

85% reflectance for both reflectors 1 kk rays traced 13 mm (0.51") outer reflector movement for beam size change Some of the optical characteristics of the prototype system, which were obtained theoretically (via simulation), are summarized in Table 1 below:

TABLE 1

| Beam angle | On-axis efficiency | Divergence |
|---|---|---|
| Narrow | 31 cd/lm | 5.0 to 6.0 degrees Full width at half-maximum (FWHM) |
| Wide | 1.2 cd/lm | 65 degrees full cut-off |

The on-axis efficiency indicates the efficiency of light collection within a central measurement point in candelas/lumen and can be described as:

$$OnAxisEfficiency = \frac{\text{Intensity}}{\text{Flux}}$$

FIG. 30 shows traces of exemplary light rays emanating from the LED and passing through the lighting system while the reflectors are in a narrow beam position (extended position, e.g., as shown in FIG. 22) to generate a bright central spot surrounded by a lower intensity annulus. FIG. 31 shows in turn traces of exemplary light rays emanating from the LED and passing through the lighting system while the reflectors are in a wide beam position (retracted position, e.g., as shown in FIG. 23) to generate a substantially uniform illumination spot on a target surface. In order to maximize the narrow beam performance, the outer reflector can index below the plane of the LER/PCB. For flashlight applications, this can be acceptable. That is, with the LED located on a structure that does not exceed the diameter of the inner reflector, the outer reflector can be positioned in the retracted position below the plane of the LED. In that way, the outer reflector can have an increased height allowing for a higher light level for the narrow beam.

FIGS. 32 and 33 show, respectively, the light intensity versus angle obtained on a target surface for the narrow-beam and the wide-beam positions of the reflectors of the prototype lighting system via simulation. FIGS. 34 and 35 in turn show exemplary narrow-beam and wide-beam illumination patterns generated by the prototype lighting system via simulation.

Figure 36:
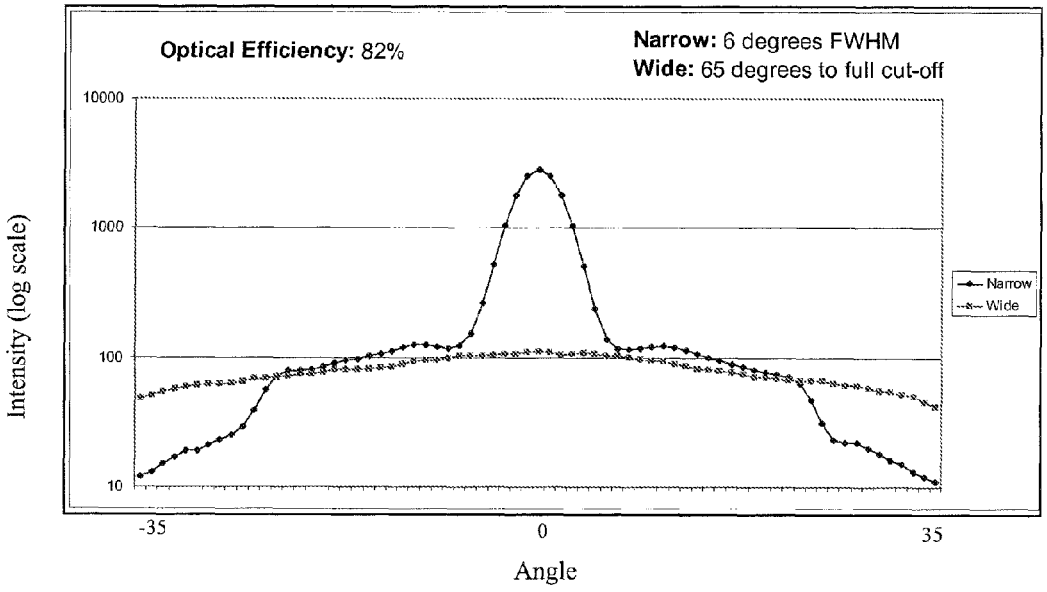
FIG. 36 is an exemplary graph plotting log intensity versus angle for an exemplary embodiment of the lighting system designed for Example 2 in accordance with the invention.

FIG. 36 is a graph obtained by simulation which illustrates further exemplary performance characteristics that can be achieved with an exemplary implementation of the design of Example 2. FIG. 36 plots intensity (log scale) vs. angle for the narrow beam position and the wide beam position across a 70 degree angle (i.e., from 35 degrees left of center to 35 degrees right of center). In the wide beam position, a beam with a distribution angle of about 65 degrees (to full cut off) can be achieved, while in the narrow beam position a beam with a distribution angle of about 6 degrees (full width at half maximum) can be achieved. The optical efficiency was determined to be approximately 82% in the narrow beam position and at least about 85% in the wide beam position. FIG. 37 is a table containing the values used to plot FIG. 36.

Appendix to Example 2: Inner Reflector Faceting Design Variants

The following is a description of an exemplary design process for creating uniform lighting via the use of controlled facets as indicated in Example 2:

1. Lighting Area

The lighting area can be defined as either a beam angle (total angle) or a diameter at a distance.

Define the lighting area to provide the limiting exit angle from the reflector.

2. Base Curve

Start the design by creating a base curve.

The base curve can generally be concave surrounding the light source and can be parabolic or spherical.

3. Uniformity Considerations

Seek to create a uniform lighting field.

As a reflector is the optical element to control the light, there is a portion of the light from the source that is not controlled (e.g., because it is not incident on the reflector). Hence, direct light away from the central region in order to create a uniform lighting field.

4. Segmenting Base Curve

Separate the base curve into separate segments.

Smaller segments can be useful in order to allow for multiple overlapping sections of the light source directed to the same location in the lighting field.

The minimum segment size is dictated by manufacturing tolerances and the balance to create as many individual overlapping lighting sections.

5. Build Up Facet Segments

Geometrically, each facet segment is constructed based on spreading the light away from the central region to create many overlapping light projections.

The shape of the facet may be straight or have a concave or convex type profile.

The shape may also be modified with a more complex profile for specific lighting requirements depending on the distribution of light from the source.

6. Creation of $2^{nd}$ Axis

Create a second axis from the initial 2D facet segment profile.

This second axis may be the same profile as the first or this axis can also be modified asymmetrically to change the lighting distribution.

7. Revolution of Facet Column

Upon creation of a column of facets, revolve this column about a central axis and trim to fit the dimensional constraints of the reflector.

8. Final 3D Model

Construct a final 3D model from the surface build up based on the mechanical requirements for attachment relative to the light source.

Example 3

Based on the design results presented in Example 2, a prototype was fabricated for verification of the design intent.

System Setup:

LED: Cree XR-E 7090 cool white

Flux was set at about 38 lumens

The reflectors were formed of polycarbonate with their inner surfaces metalized via a vacuum aluminum metallization process to provide reflective surfaces. Both reflectors had generally paraboloid profiles. While the inner reflective surface of the outer reflector was smooth, the inner reflective surface of the inner reflector included a plurality of facets.

Some of the optical performance characteristics of the prototype, which were obtained experimentally from the fabricated device, are listed in Table 2 below:

TABLE 2

| Solution | On-axis efficiency | Efficiency |
|---|---|---|
| Fraen | 24 cd/lm | 75.2% |

The prototype lighting system provided excellent narrow-beam and very good wide-beam aesthetic quality as well as very high efficiency (in calculating the efficiency, a factor of 0.9 was assumed to account for cover window losses). The on-axis performance of the narrow beam is equal or better than production products of similar size.

By way of illustration, FIG. 38 shows a simulation of a narrow-beam illumination that the prototype lighting system was expected to generate while FIG. 39 shows a photograph of the narrow-beam illumination actually provided by the lighting system. FIG. 40 shows a simulation of a wide-beam illumination pattern that the prototype lighting system was expected to generate while FIG. 41 shows a photograph of the narrow-beam illumination actually provided by the lighting system.

Example 4

Figure 42:
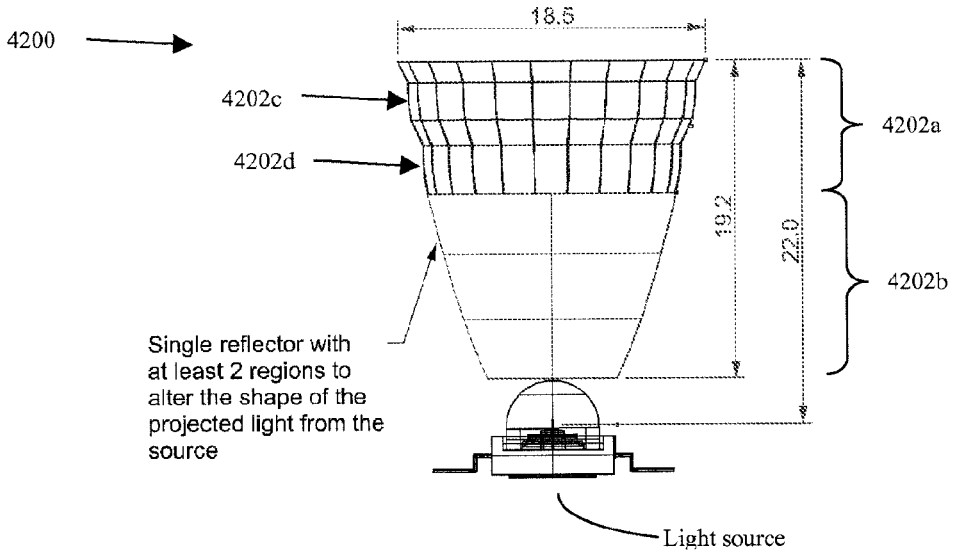
FIG. 42 is a schematic view of an exemplary lighting system as designed for Example 4.
Figure 43:
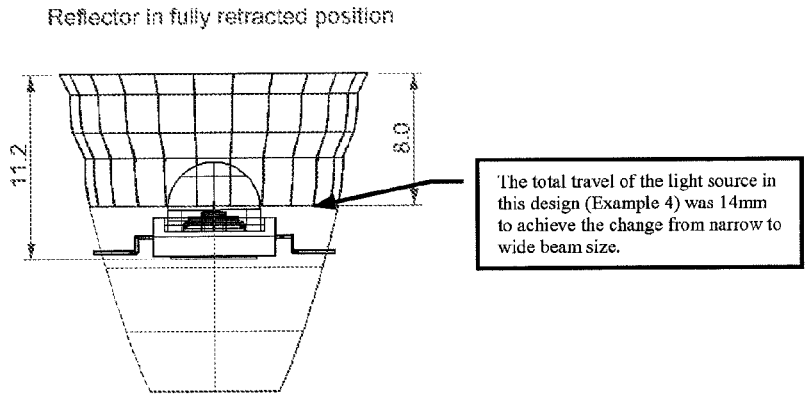
FIG. 43 is a schematic view of an exemplary lighting system as designed for Example 4.
Figure 44A:
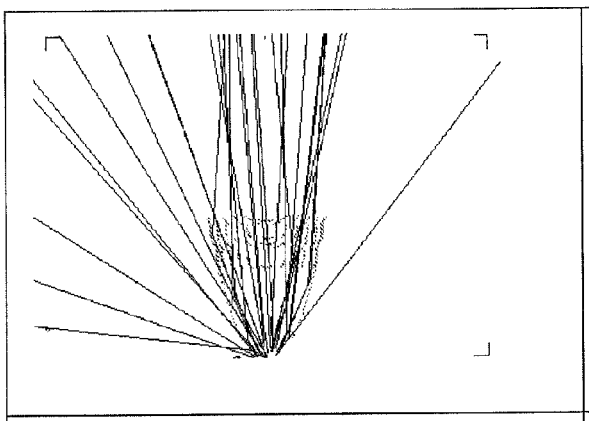
FIGS. 44A through 44G are exemplary ray traces for the lighting system of FIGS. 42-43.
Figure 44B:
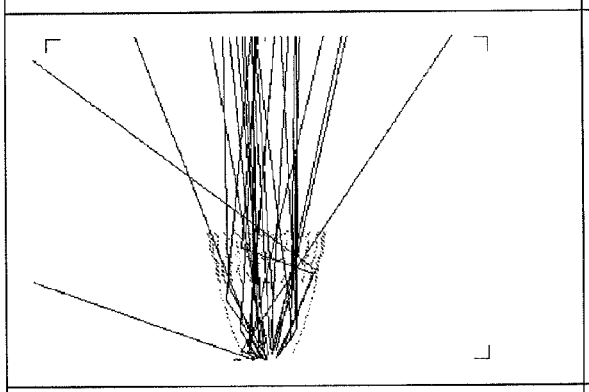
Figure 44C:
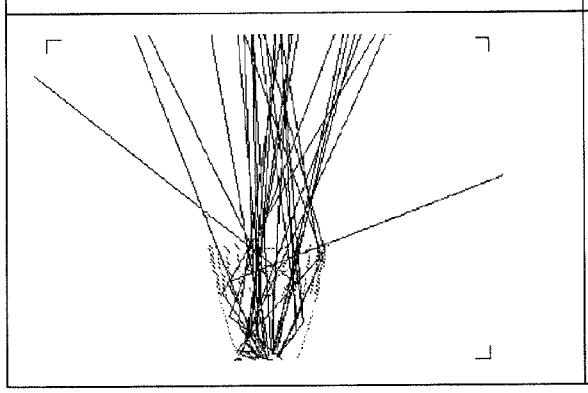
Figure 44D:
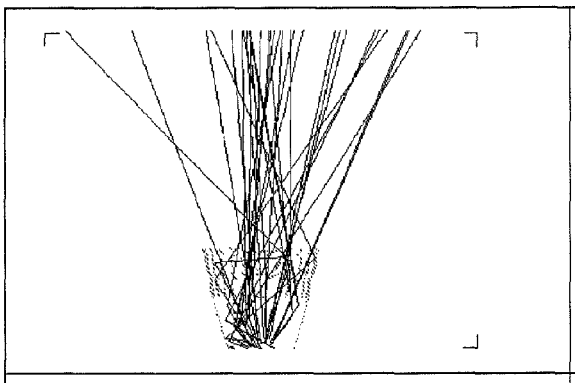
Figure 44E:
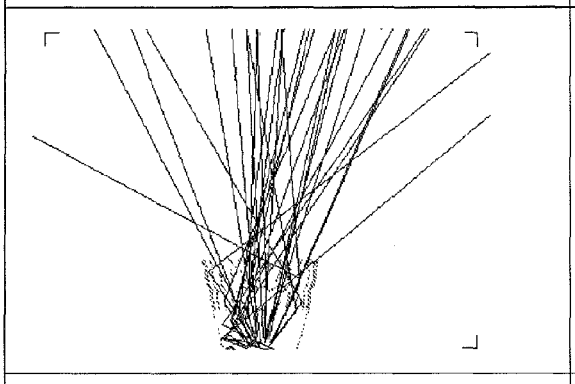
Figure 44F:
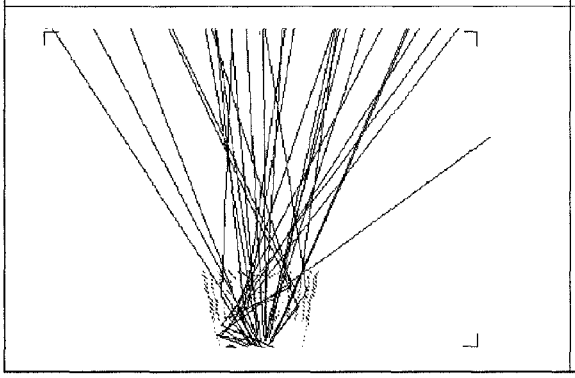
Figure 44G:
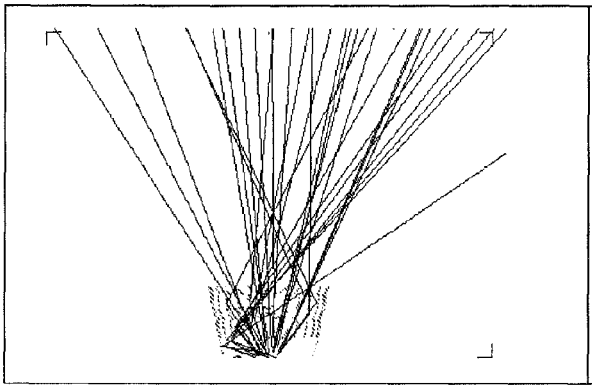
Figure 45A:
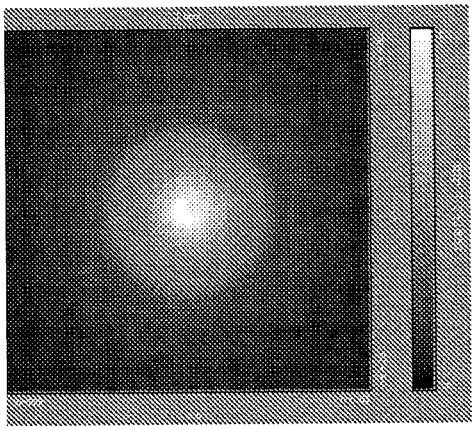
FIGS. 45A through 45G are exemplary light patterns corresponding to the ray traces of FIGS. 44A through 44G, respectively.
Figure 45B:
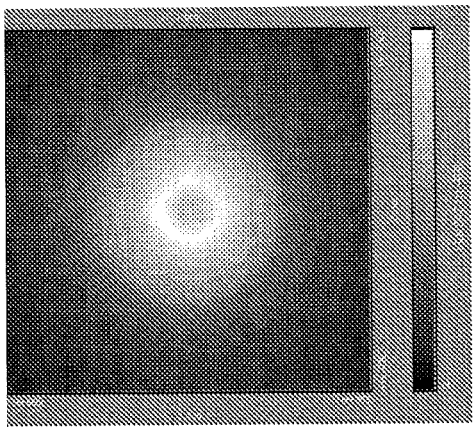
Figure 45C:
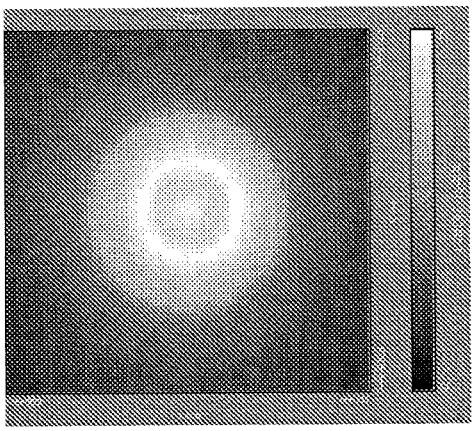
Figure 45D:
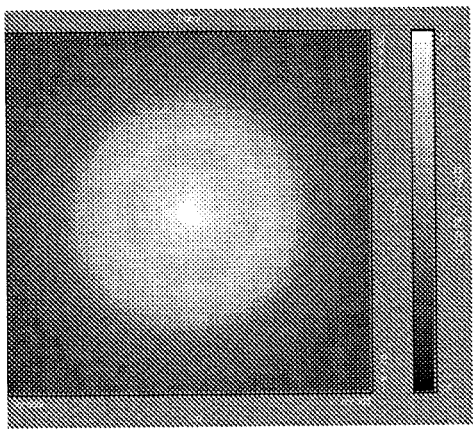
Figure 45E:
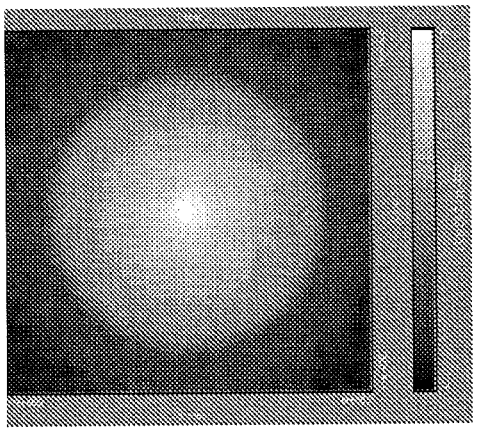
Figure 45F:
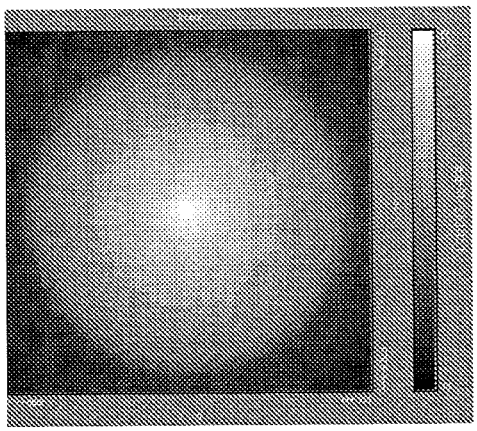
Figure 45G:
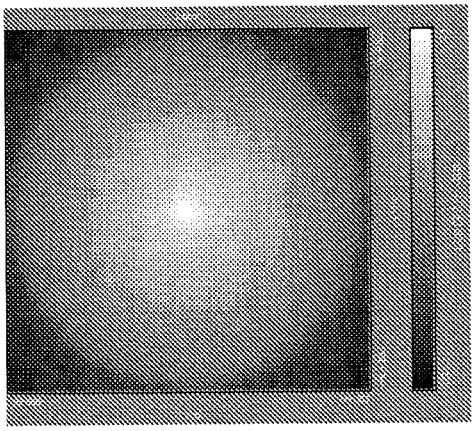

With reference to FIGS. 42 and 43, a prototype light system was designed and simulated that included a reflector 4200 having a distal reflective region 4202*a* and a proximal reflective region 4202*b*. In this design, the reflector 4200 is coupled to a light source to receive light at a proximal end thereof and to redirect light to exit at a distal end thereof. The light source and the reflector were designed to be axially movable relative to one another. The total travel of the light source in this design was selected to be 14 mm to achieve the change from narrow to wide beam size. In this implementation, the reflector was adapted to be movable relative to the light source though in other implementations the light source can be movable while the reflector remains fixed or both the light source and the reflector can be movable. In this implementation, the total travel distance of the relative motion of the reflector and the light source was designed to be about 14 mm to achieve a change from a narrow-beam to a wide-beam position.

The reflector was designed for high volume manufacturing suitable for a variety of applications, such as consumer, industrial and military applications. The reflector was designed to be fabricated via molding of polycarbonate material (in other implementations other materials such as polymethylmethacrylate (PMMA), polystyrene, ultem can be employed). The inner surfaces of the reflector were designed to be metalized with aluminum (in other implementations other metals can be employed) to provide reflective surfaces exhibiting a minimum reflectivity of about 85% to redirect the light incident thereon. The design was such that in many applications, the reflector can be adjusted by the end user to change the size of projected light spot.

Design Method/Details:

In this Example 4, the design of the prototype lighting system was performed using the following steps:

- Define the maximum diameter of the reflectors (in this case 18.5 mm was selected as the maximum diameter)
- Chose a light source (LED marketed by Philips-Lumileds of San Jose, Calif., USA under trade designation K2 was chosen as the light source)
- An optimized smooth parabolic shape was determined for the light distribution from the source
- The base shape optimization also included adjustment of the height and the chosen value was a balance between the maximum on-axis performance and overall dimension. The diameter of the inner reflector was fixed to 10 mm. This diameter size was chosen based on manufacturing considerations. The outer reflector was then constructed with a diameter of 18.5 mm. The height of the outer reflector was derived based on a parabolic form that would allow movement of the outer reflector with respect to the inner reflector.
- The base shape was purposed into two different segments or regions. The regions were sized relative to one another in a ratio of about 1.4:1, where the larger region was the reflector for the wide beam (or flood beam pattern), e.g., region 4202*a* as shown in FIG. 42. This proportion can be adjusted to achieve a different balance between peak luminance (at a given target distance) and sufficient surface area to create a substantially uniform wide beam.
- The base profile of distal region (e.g., region 4202*a* as shown in FIG. 42) was divided into 2 sectors, called facets, which are shown as 4202*c* and 4202*d* in FIG. 42. Each facet had a square size and the shape of the geometry was chosen to spread the light evenly from near the axis (e.g., 0 degrees or substantially parallel to the axis) out to the full extent as defined by the edge ray of light (e.g., the ray of light reflected at the largest angle relative to the axis).
- The proximal region (e.g., proximal region 4202*b* as shown in FIG. 42) remained a smooth, optimized profile to provide the maximum light in the central spot.

Beam Pattern Vs. Reflector Position to LED:

FIGS. 44A-44G show a set of twelve exemplary simulated ray traces for light from the LED passing through the reflector of the prototype lighting system at different relative positions of the light source and the reflector. FIGS. 45A-45G show theoretically calculated light patterns corresponding to the ray traces shown in FIGS. 44A-44G (FIG. 45A corresponds to FIG. 44A, and so forth.) The ray trace/light pattern pairs represent a progression as the position of the light source is moved distally relative to the reflector, thereby increasing the flood beam. The step size between successive ray trace/light pattern pairs was approximately 2.4 mm except for the step size between the ray traces/patterns shown in FIGS. 44F/45F and 44G/45G, which was about 1.2 mm. In other words, each successive ray trace/light pattern corresponds to a distal movement (or position change) of approximately 2.4 mm (or 1.2 mm) of the light source relative to the reflector.

Any of the reflectors and lenses described in this application, including the foregoing Examples 1-4, can be made of polymethyl methacrylate (PMMA), glass, polycarbonate, cyclic olefin copolymer and cyclic olefin polymer, or any other suitable material. By way of example, the reflectors can be formed by injection molding, by mechanically cutting a reflector or lens from a block of source material and/or polishing it, by forming a sheet of metal over a spinning mandrel, by pressing a sheet of metal between tooling die representing the final surface geometry including any local facet detail, and so on. Reflective surfaces can be created by a vacuum metallization process which deposits a reflective metallic (e.g., aluminum) coating, by using highly reflective metal substrates via spinning or forming processes. Faceting on reflector surfaces can be created by injection molding, by mechanically cutting a reflector or lens from a block of source material and/or polishing it, by pressing a sheet of metal between tooling die representing the final surface geometry including any local facet detail, and so on.

Any appended claims are incorporated by reference herein and are considered to represent part of the disclosure and detailed description of this patent application. Moreover, it should be understood that the features illustrated or described in connection with any exemplary embodiment may be combined with the features of any other embodiments. Such modifications and variations are intended to be within the scope of the present patent application.

The invention claimed is:

1. A lighting system, comprising an inner reflector extending from a proximal end to a distal end along an axis and adapted to receive light from a light source at its proximal end;

an outer reflector extending from a proximal end to a distal end through which light can exit the outer reflector, said inner and outer reflectors being coupled for axial movement relative to one another over a range of relative positions between a retracted position and an extended position, wherein the reflectors are sized and the light source is positioned relative to the proximal end of the inner reflector such that in said retracted position more than about 90% of the light emitted by the light source that enters the inner reflector exits the distal end of the outer reflector without undergoing any reflection by the outer reflector or the inner reflector, and wherein the light exiting said outer reflector exhibits a progressively decreasing flood spread as the relative position of the reflectors is transitioned from said retracted position to said extended position.

2. The lighting system of claim 1, wherein an axial overlap between the two reflectors is less in said extended position than in said retracted position.

3. The lighting system of claim 2, wherein said retracted position is characterized by a maximum axial overlap between the two reflectors within said range of relative positions, and said extended position is characterized by a minimum axial overlap between the two reflectors within said range of relative positions.

4. The lighting system of claim 3, wherein the distal end of said inner reflector axially abuts the proximal end of said outer reflector in said extended position.

5. The lighting system of claim 1, wherein said inner and outer reflectors are configured to move telescopically relative to one another.

6. The lighting system of claim 1, wherein the light source is disposed at a focal point of the outer reflector when the inner and outer reflectors are in the extended position.

7. The lighting system of claim 1, wherein the light source is attached to the inner reflector.

8. The lighting system of claim 1, wherein the outer reflector collimates light received from the light source for at least one position of the outer reflector along the axis.

9. The lighting system of claim 1, wherein the light source comprises a light emitting diode.

10. A lighting system, comprising an inner reflector extending from a proximal end to a distal end along an axis and adapted to receive light from a light source at its proximal end, an outer reflector extending from a proximal end to a distal end through which light can exit the outer reflector, said inner and outer reflectors being coupled for axial movement relative to one another over a range of relative positions between a retracted position and an extended position, wherein the reflectors are sized and the light source is positioned relative to the proximal end of the inner reflector such that in said refracted position more than about 80% of the light emitted by the light source that enters the inner reflector exits the distal end of the outer reflector without undergoing any reflection by the outer reflector, and wherein the reflectors are sized and the light source is positioned relative to the proximal end of the inner reflector such that in said refracted position more than about 80% of the light emitted by the light source that enters the inner reflector exits from the distal end of the outer reflector without undergoing any reflection by the outer reflector or the inner reflector, and wherein the light exiting said outer reflector exhibits a progressively decreasing flood spread as the relative position of the reflectors is transitioned from said retracted position to said extended position.

11. A lighting system, comprising an inner reflector extending from a proximal end to a distal end along an axis and adapted to receive light from a light source at its proximal end, an outer reflector extending from a proximal end to a distal end through which light can exit the outer reflector, said inner and outer reflectors being coupled for axial movement relative to one another over a range of relative positions between a retracted position and an extended position, wherein the reflectors are sized and the light source is positioned relative to the proximal end of the inner reflector such that in said refracted position more than about 80% of the light emitted by the light source that enters the inner reflector exits the distal end of the outer reflector without undergoing any reflection by the outer reflector, and wherein the reflectors are sized and the light source is positioned relative to the proximal end of the inner reflector such that in said refracted position more than about 90% of the light emitted by the light source that enters the inner reflector exits the distal end of the outer reflector without undergoing any reflection by the outer reflector or the inner reflector, and wherein the light exiting said outer reflector exhibits a progressively decreasing flood spread as the relative position of the reflectors is transitioned from said retracted position to said extended position.

12. A lighting system, comprising:

an inner reflector extending from a proximal end to a distal end along an axis and adapted to receive light from a light source at its proximal end, an outer reflector extending from a proximal end to a distal end through which light can exit the outer reflector, said inner and outer reflectors being coupled for axial movement relative to one another over a range of relative positions between a retracted position and an extended position, wherein the reflectors are sized and the light source is positioned relative to the proximal end of the inner reflector such that in said refracted position more than about 80% of the light emitted by the light source that enters the inner reflector exits the distal end of the outer reflector without undergoing any reflection by the outer reflector or the inner reflector.

13. The lighting system of claim 12, wherein in said retracted position more than about 90% of the light from the light source that enters the inner reflector exits the distal end of the outer reflector without undergoing any reflection by the outer reflector or the inner reflector.

14. A lighting system, comprising an inner reflector extending from a proximal end to a distal end along an axis and adapted to receive light from a light source, an outer reflector extending from a proximal end to a distal end through which light can exit the outer reflector, said inner and outer reflectors being coupled for axial movement relative to one another over a range of relative positions between a retracted position and an extended position such that in said extended position the inner reflector and the outer reflector axially abut one another to form a substantially continuous reflective surface for directing at least a portion of the light received from the light source via reflection to the distal end of the outer reflector, and wherein the reflectors are sized and the light source is positioned relative to the proximal end of the inner reflector such that in said refracted position more than about 80% of the light emitted by the light source that enters the inner reflector exits the distal end of the outer reflector without undergoing any reflection by the outer reflector, and wherein in said retracted position more than about 80% of the light emitted by the light source that enters the inner reflector exits the distal end of the outer reflector without undergoing any reflection by the outer reflector or the inner reflector, and wherein the light exiting said outer reflector exhibits a progressively decreasing flood spread as the relative position of the reflectors is transitioned from said retracted position to said extended position.

15. The lighting system of claim 14, wherein said substantially continuous reflective surface is a parabolic surface.

16. The lighting system of claim 14, wherein in said retracted position more than about 90% of the light emitted by the light source that enters the inner reflector exits the distal end of the outer reflector without undergoing any reflection by the outer reflector.

* * * * *